US010825394B2

(12) United States Patent
Kim et al.

(10) Patent No.: US 10,825,394 B2
(45) Date of Patent: Nov. 3, 2020

(54) DISPLAY DEVICE

(71) Applicant: SAMSUNG DISPLAY CO., LTD., Yongin-si, Gyeonggi-Do (KR)

(72) Inventors: Mi Hae Kim, Asan-si (KR); Hyun Ji Kang, Hwaseong-si (KR); Kyung Hoon Kim, Uiwang-si (KR); Jae Du Noh, Mokpo-si (KR); Jeong Hun Bang, Yongin-si (KR); Kyong Hwan Oh, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 16/575,661

(22) Filed: Sep. 19, 2019

(65) Prior Publication Data

US 2020/0302860 A1 Sep. 24, 2020

(30) Foreign Application Priority Data

Mar. 19, 2019 (KR) ..... 10-2019-0031354

(51) Int. Cl.

| | |
|---|---|
| ***G09G 3/325*** | (2016.01) |
| ***G09G 3/3258*** | (2016.01) |
| ***G09G 3/3266*** | (2016.01) |
| ***G09G 3/3291*** | (2016.01) |

(52) U.S. Cl.

CPC ..... *G09G 3/325* (2013.01); *G09G 3/3258* (2013.01); *G09G 3/3266* (2013.01); *G09G 3/3291* (2013.01); *G09G 2310/0278* (2013.01)

(58) Field of Classification Search

CPC .... G09G 3/325; G09G 3/3291; G09G 3/3266; G09G 3/3258; G09G 2310/0278

See application file for complete search history.

(56) References Cited

U.S. PATENT DOCUMENTS

| | | | | |
|---|---|---|---|---|
| 2006/0012587 | A1* | 1/2006 | Stevenson | G09G 3/3233 345/204 |
| 2007/0139314 | A1* | 6/2007 | Park | G09G 3/3233 345/76 |
| 2015/0108437 | A1* | 4/2015 | Cho | G09G 3/3233 257/40 |

FOREIGN PATENT DOCUMENTS

| | | |
|---|---|---|
| KR | 10-0570995 | 4/2006 |
| KR | 10-2018-0112193 | 10/2018 |

* cited by examiner

*Primary Examiner* — Premal R Patel

(74) *Attorney, Agent, or Firm* — F. Chau & Associates, LLC

(57) ABSTRACT

A display device is described comprising sub-pixels that include: a first driving transistor and a second driving transistor, each of which control a current flowing from a first electrode to a second electrode in accordance with a data voltage applied to a gate electrode; a light emitting element connected to the second electrodes of the first driving transistor and the second driving transistor; and a first contact hole and a second contact hole which are disposed in the gate electrode, wherein the gate electrode includes a first gate electrode overlapping the first driving transistor in a thickness direction and a second gate electrode overlapping the second driving transistor in the thickness direction, and the first contact hole is located in the first gate electrode, the second contact hole is located in the second gate electrode, and the first contact hole and the second contact hole overlap each other.

21 Claims, 19 Drawing Sheets

DISPLAY DEVICE

This application claims priority from and the benefit of Korean Patent Application No. 10-2019-0031354 filed on Mar. 19, 2019, which is hereby incorporated by reference for all purposes as if fully set forth herein.

BACKGROUND

1. Field of the Invention

The present invention relates to a display device.

2. Description of the Related Art

With the increasing importance of information dissemination in society, requirements for display devices of various forms have continue to increase. For example, display devices are used with various electronic appliances such as smart phones, digital cameras, notebook computers, navigators, and smart televisions. A display device may be a flat panel display device such as a liquid crystal display device, a field emission display device, or a light emitting display device. In a light emitting display device (i.e., in a flat panel display), pixels of the display panel include a light emitting element capable of self-emitting light, which enables the light emitting display device may display an image without a backlight unit for providing light to the display panel.

The light emitting display device may include a plurality of pixels, and each of the plurality of pixels may include a light emitting element, a driving transistor for adjusting the amount of a driving current supplied to the light emitting element according to the voltage of a gate electrode, and a scan transistor for supplying the data voltage of a data line to the gate electrode of the driving transistor in response to the scan signal of a scan line. However, in some cases, the luminance of the pixels is not sufficient to provide optimal image quality. Therefore, there is demand for a light emitting element with a high luminance output to improve the quality of an image of a light emitting display device.

SUMMARY

Aspects of the present invention are to provide a display device capable of improving the quality of an image.

An exemplary embodiment of the present invention provides a display device. The display device comprising: a sub-pixel including a light emitting area; wherein the sub-pixel includes: a first driving transistor and a second driving transistor, each of which control a current flowing from a first electrode to a second electrode in accordance with a data voltage applied to a gate electrode; a light emitting element connected to the second electrodes of the first driving transistor and the second driving transistor; and a first contact hole and a second contact hole which are disposed in the gate electrode, wherein the gate electrode includes a first gate electrode overlapping the first driving transistor in a thickness direction and a second gate electrode overlapping the second driving transistor in the thickness direction, and the first contact hole is located in the first gate electrode, the second contact hole is located in the second gate electrode, and the first contact hole and the second contact hole overlap each other in a first direction perpendicular to the thickness direction.

However, aspects of the present invention are not restricted to the one set forth herein. The above and other aspects of the present invention will become more apparent to one of ordinary skill in the art to which the present invention pertains by referencing the detailed description of the present invention given below.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION OF THE EMBODIMENTS

Figure 1:
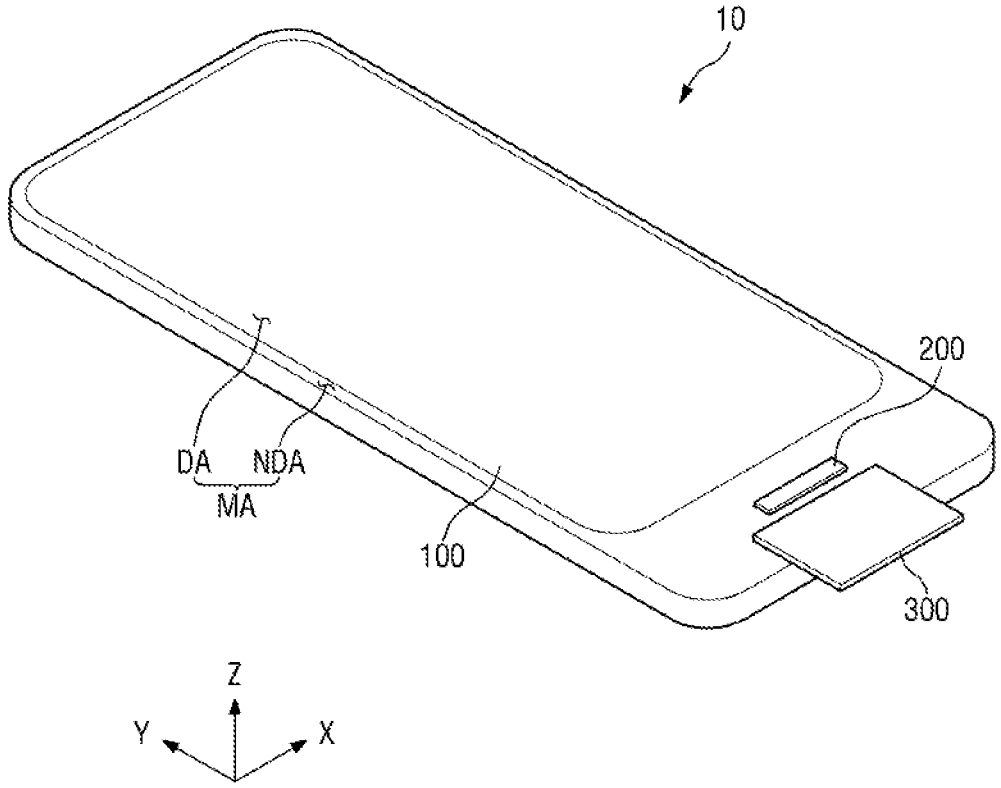
FIG. 1 is a perspective view of a display device according to an embodiment.

The present disclosure describes systems and methods that provide for a high luminance output of a display device. Luminance is a measure of the power emitted by a light source, per unit area. Example embodiments include pixels having a dual transistor in which two driving transistors are connected in parallel. By using a parallel arrangement of the driving transistors, the disclosed can provide a high driving current, thereby increasing the luminance of the pixels.

Example embodiments also include two contact holes which are arranged in a first gate electrode of the first driving transistor and a second gate electrode of the second driving transistor. The two contact holes may be symmetrical to each other with respect to the boundary between the gate electrodes and may overlap each other vertically. This arrangement may reduce the characteristic deviation between active layers of the two driving transistors, which may help prevent the deterioration of image quality.

Specific details are set forth in the following description for the purpose of explanation to provide a thorough understanding of various exemplary embodiments of the invention. As used herein "embodiments" are non-limiting examples of devices or methods employing one or more of the inventive concepts disclosed herein. However, various exemplary embodiments may be practiced without these specific details or with one or more equivalent arrangements. In some instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed at the same time or performed in an order opposite to the described order. Also, like reference numerals denote like elements.

When an element, such as a layer, is referred to as being "on," "connected to," or "coupled to" another element or layer, the element may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another or may represent different directions that are not perpendicular to one another. For the purposes of this disclosure, "at least one of X, Y. and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

In this specification, the "on", "over", "top", "upper side", or "upper surface" refers to an upward direction, that is, a Z-axis direction, with respect to a display panel 100, and the "beneath", "under", "bottom", "lower side", or "lower surface" refers to a downward direction, that is, a direction opposite to the Z-axis direction, with respect to the display device 10. Further, the "left", "right", "upper", and "lower" refer to directions when the display panel 100 is viewed from the plane. For example, the "left" refers to a direction opposite to the X-axis direction, the "right" refers to the X-axis direction, the "upper" refers to the Y-axis direction, and the "lower" refers to a direction opposite to the Y-axis direction.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as limited to the illustrated shapes of regions but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, embodiments of the present invention will be described with reference to the attached drawings.

FIG. 1 is a perspective view of a display device according to an embodiment. A display device 10, which is a device for displaying a moving image or a still image, may be used as a display screen of various products such as televisions, notebooks, monitors, billboards, internet of things (IOTs) as well as portable electronic appliances such as mobile phones, smart phones, tablet personal computers (tablet PCs), smart watches, watch phones, mobile communication terminals, electronic notebooks, electronic books, portable multimedia players (PMPs), navigators, and ultra-mobile PCs (UMPCs).

The display device 10 may be a light emitting display device such as an organic light emitting display device using an organic light emitting diode, a quantum dot light emitting display device including a quantum dot light emitting layer, an inorganic light emitting display device including an inorganic semiconductor, or a micro light emitting display device using a micro light emitting diode (LED). Hereinafter, the display device 10 will be described as an organic light emitting display device, but the present invention is not limited thereto.

The display device 10 includes a display panel 100, a display driving circuit 200, and a circuit board 300.

The display panel 100 may have a rectangular planar shape having short sides in the first direction (X-axis direction) and long sides in the second direction (Y-axis direction). The corner where the short side in the first direction (X-axis direction) meets the long side in the second direction (Y-axis direction) may be formed to have a round shape of a predetermined curvature or have a right-angle shape. The planar shape of the display panel 100 is not limited to a rectangular shape, and may be formed in another polygonal shape, circular shape, or elliptical shape. The display panel 100 may be formed to be flat. However, the present invention is not limited thereto, and the display panel 100 may include a curved portion formed at the left and right ends thereof and having a constant curvature or a variable curvature. In addition, the display panel 100 may be flexible to be bent, warped, folded, or rolled.

Figure 2:
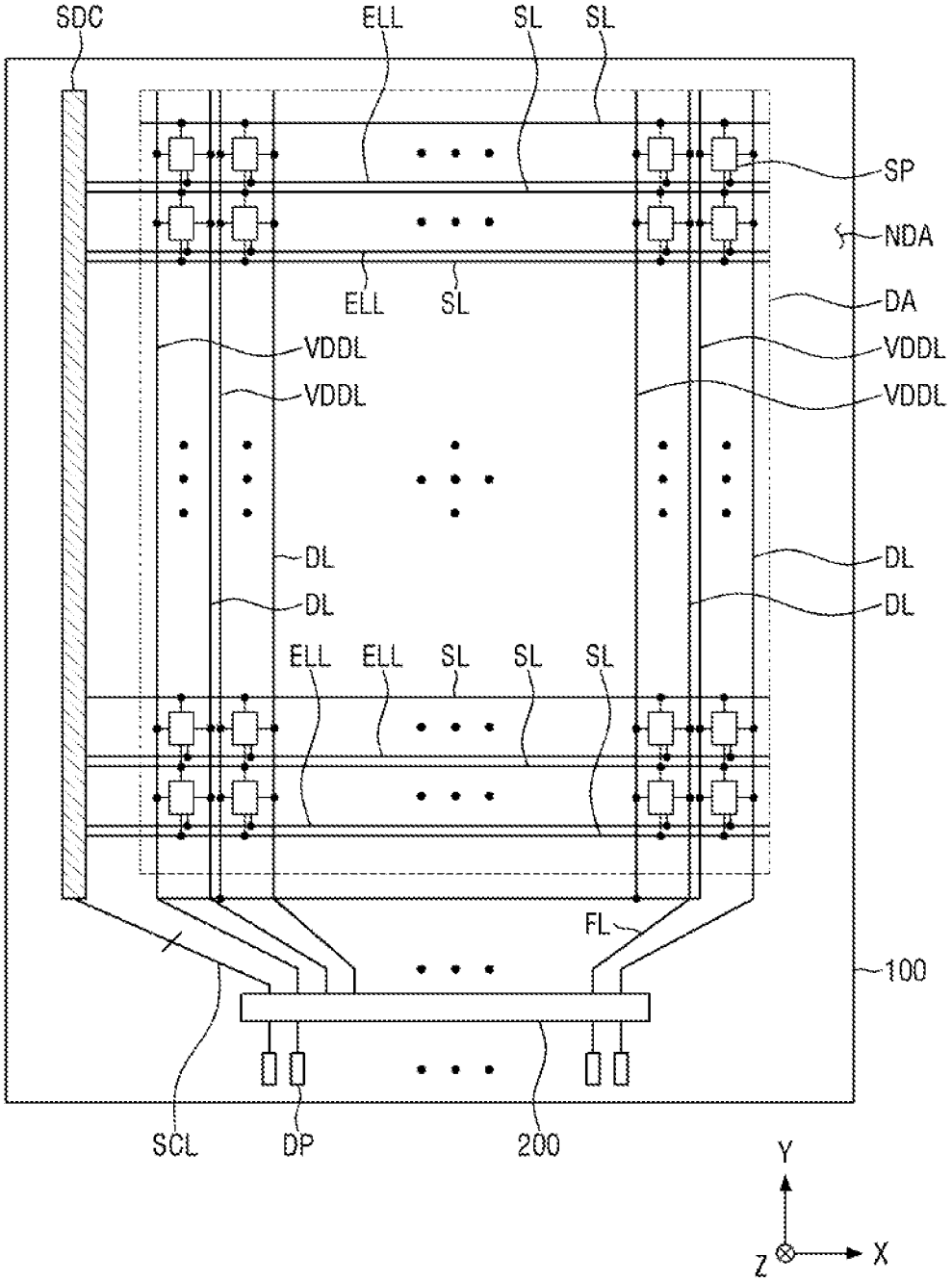
FIG. 2 is a plan view of a display device according to an embodiment.

FIG. 2 is a plan view of a display device according to an embodiment. The display panel 100 may include a display area DA in which sub-pixels SP are formed to display an image, and a non-display area NDA which is a peripheral area of the display area DA. The display area DA may be provided with scan lines SL, light emitting lines ELL, data lines DL, and first driving voltage line VDDL, which are connected to the sub-pixels SP, in addition to the sub-pixels SP. The scan lines SL and the light emitting lines ELL may be arranged in parallel in the first direction (X-axis direction), and the data lines DL may be arranged in parallel in the second direction (Y-axis Direction). The first driving voltage lines VDDL may be arranged in parallel in the second direction (Y-axis direction) in the display area DA. The first driving voltage lines VDDL arranged in parallel in the second direction (Y-axis direction) in the display area DA may be connected to each other in the non-display area NDA.

Each of the sub-pixels SP may be connected to at least one of the scan lines SL, at least one of the data lines DL, at least one of the light emitting lines ELL, and the first driving voltage line VDDL. Although shown in FIG. 2 that each of the sub-pixels SP are connected to two scan lines SL, one data line DL, one light emitting line ELL, and the first driving voltage line VDDL, the present invention is not limited thereto, and, for example, each of the sub-pixels SP may be connected to three scan lines SL, not two scan lines SL.

Each of the sub-pixels SP may include a driving transistor, at least one transistor, a light emitting element, and a capacitor. The transistor is turned on when a scan signal is applied from the scan line SL, and thus a data voltage of the data line DL may be applied to a gate electrode of the driving transistor DT. The driving transistor DT may supply a driving current to the light emitting element in accordance with the data voltage applied to the gate electrode, thereby emitting light. The driving transistor DT and the at least one transistor ST may be thin film transistors. The light emitting element may emit light in accordance with the driving current of the driving transistor DT. In order to increase the driving current, one sub-pixel SP may be provided with the plurality of driving transistors DT.

According to various embodiments of the present disclosure, the sub-pixels SP may include a first driving transistor; a second driving transistor connected in parallel to the first driving transistor; a light emitting element connected to electrodes of the first driving transistor and the second driving transistor; a first contact hole located within a first gate electrode of the first driving transistor; and a second contact hole located within a second gate electrode of the second driving transistor, and overlapping the first contact hole in a direction perpendicular to a thickness direction.

Figure 4:
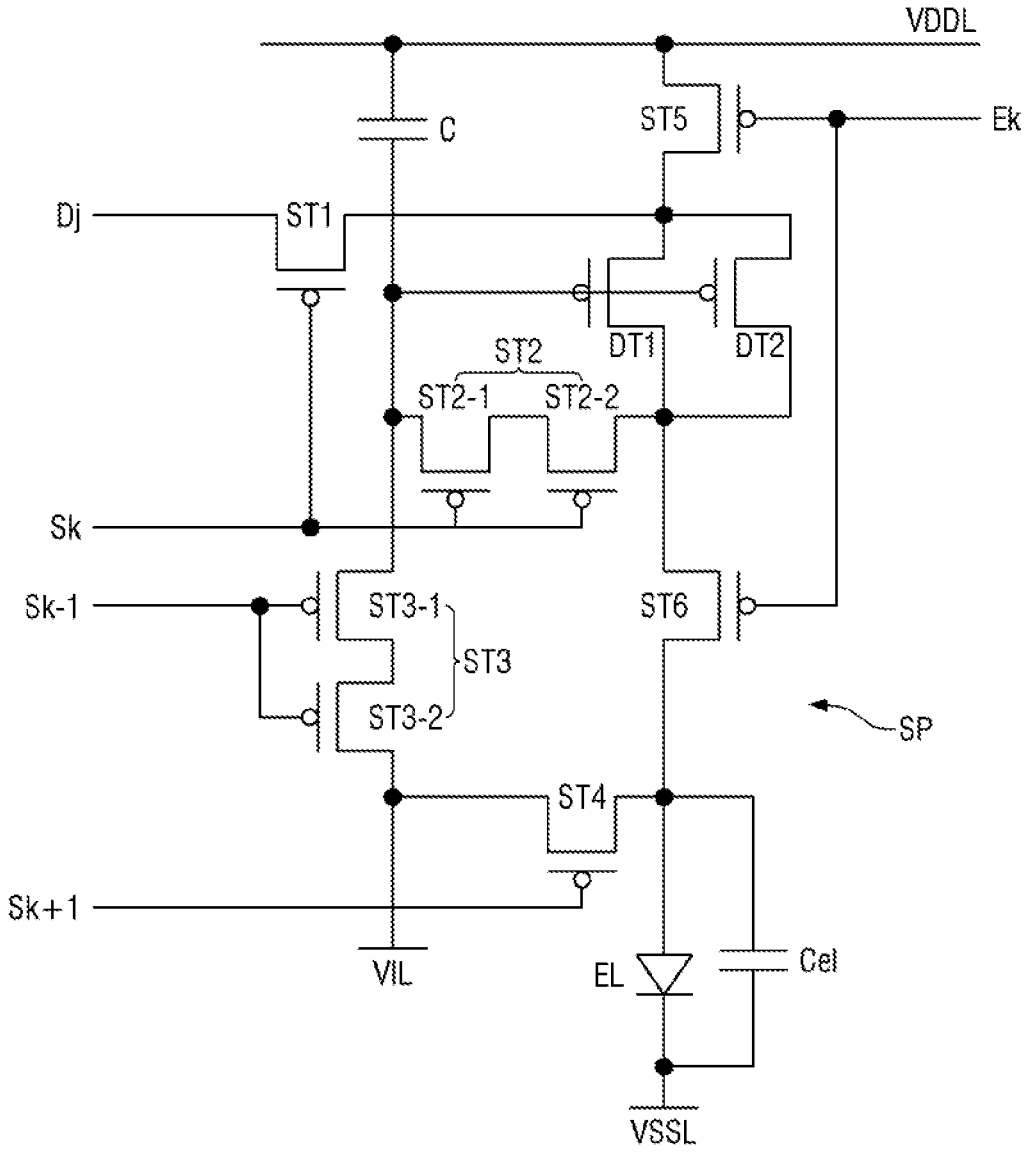
FIG. 4 is a detailed circuit diagram of a sub-pixel according to an embodiment.

For example, as shown in FIG. 4, the driving transistor DT may be a dual transistor including a first driving transistor DT1 and a second driving transistor DT2. The light emitting element may be an organic light emitting diode including a first electrode, an organic light emitting layer, and a second electrode. The capacitor may serve to keep the data voltage applied to the gate electrode of the driving transistor DT constant.

The non-display area NDA may be defined as an area from the outside of the display area DA to the edge of the display panel 100. The non-display area NDA may be provided with a scan driving circuit SDC for applying scan signals to the scan lines SL, fan-out lines FL between the data lines DL and the display driving circuit 200, and pads DP connected to the display driving circuit 200. The display driving circuit 200 and the pads DP may be disposed at one side edge of the display panel 100. The pads DP may be disposed adjacent to one side edge of the display panel 100 rather than the display driving circuit 200.

The scan driving circuit SDC may be connected to the display driving circuit 200 through a plurality of scan control lines SCL. The scan driving circuit SDC may receive a scan control signal SCS and a light emission control signal ECS from the display driving circuit 200 through the plurality of scan control lines SCL.

Figure 3:
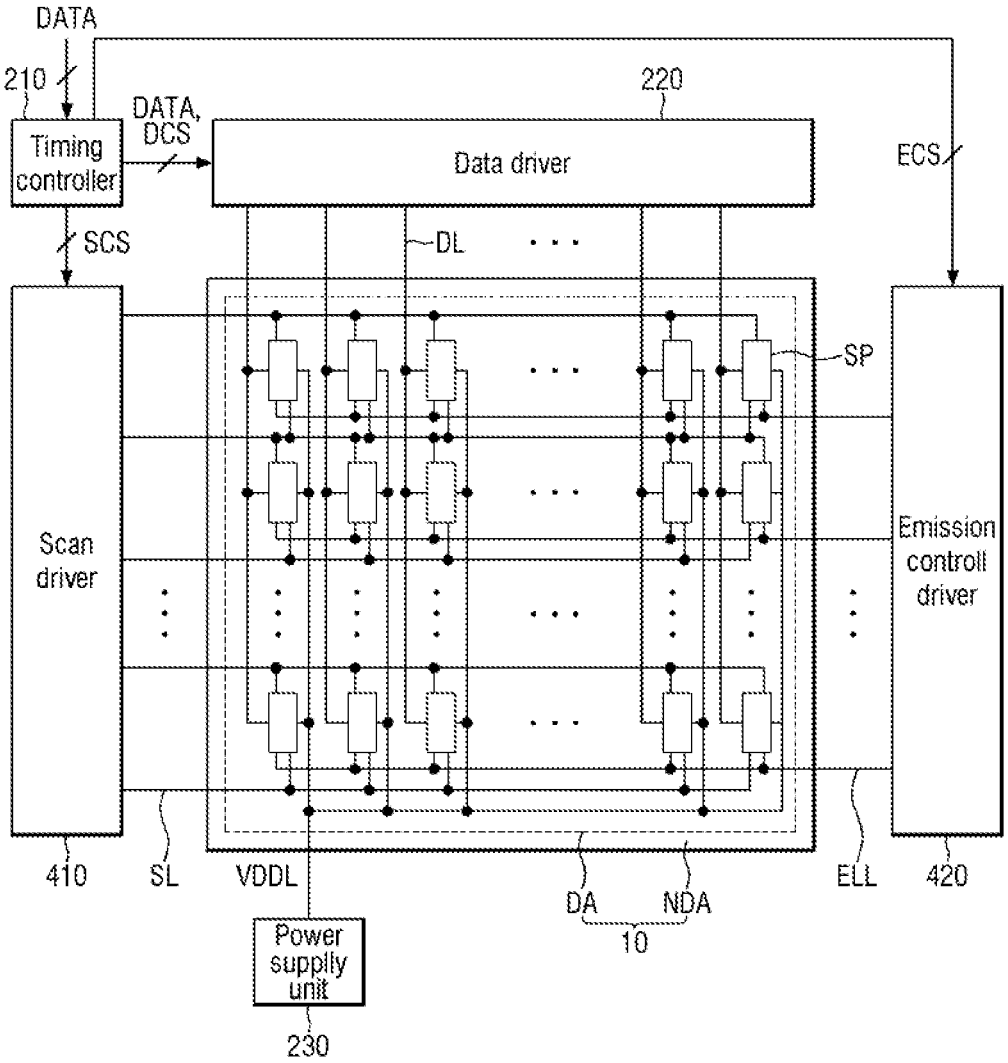
FIG. 3 is a block diagram of a display device according to an embodiment.

FIG. 3 is a block diagram of a display device according to an embodiment. As shown in FIG. 3, the scan driving circuit SDC may include a scan driver 410 and a light emission control driver 420.

The scan driver 410 may generate scan signals according to the SCS, and may sequentially output the scan signals to the scan lines SL. The light emission control driver 420 may generate light emission control signals according to the ECS, and may sequentially output the light emission control signals to the light emitting lines ELL.

The scan driving circuit SDC may include a plurality of thin film transistors and may be formed on the same layer as the thin film transistors of the sub-pixels SP. Although shown in FIG. 2 that the scan driving circuit SDC is formed in the non-display area NDA located at one side, for example, left side of the display area DA, the present invention is not limited thereto. For example, the scan driving circuit SDC may be formed in the non-display area NDA located at both sides such as the left and right sides of the display area DA.

As shown in FIG. 3, the display driving circuit 200 may include a timing controller 210, a data driver 220, and a power supply unit 230.

The timing controller 210 receives digital video data DATA and timing signals from the circuit board 300 and may generate a scan control signal SCS for controlling the operation timing of the scan driver 410 according to the timing signals. The timing controller 210 may also generate a light emission control signal ECS for controlling the operation time of the light emission control driver 420, and may generate a data control signal DCS for controlling the operation time of the data driver 220. The timing controller 210 may output the scan control signal SCS to the scan driver 410 through the plurality of scan control lines SCL and may output the light emission control signal ECS to the light emission control driver 420 and may output the digital video data DATA and the data control signal DCS to the data driver 220.

The data driver 220 converts the digital video data DATA into analog positive polarity and negative polarity data voltages and outputs these data voltages to the data lines DL through the fan-out lines FL. The sub-pixels SP are selected by the scan signals of the scan driving circuit SDC, and the data voltages are supplied to the selected sub-pixels SP.

The power supply unit 230 may generate a first driving voltage and supply the first driving voltage to the first driving voltage line VDDL and may generate a second driving voltage and supply the second driving voltage to a cathode electrode of the organic light emitting diodes of each of the sub-pixels SP. The first driving voltage may be a high-potential voltage for driving the organic light emitting diode, and the second driving voltage may be a low-potential voltage for driving the organic light emitting diode. That is, the first driving voltage may have a higher potential than the second driving voltage.

The display driving circuit 200 may be formed as an integrated circuit (IC), and may be attached onto the display panel 100 by using a chip on glass (COG) method, a chip on plastic (COP) method, or an ultrasonic bonding method, but the present invention is not limited thereto. For example, the display driving circuit 200 may be attached onto the circuit board 300.

The circuit board 300 may be attached onto the pads DP using an anisotropic conductive film. Thus, lead lines of the circuit board 300 may be electrically connected to the pads DP. The circuit board 300 may be a flexible film such as a flexible printed circuit board, a printed circuit board, or a chip on film.

FIG. 4 is a detailed circuit diagram of a sub-pixel according to an embodiment.

Referring to FIG. 4, the sub-pixel SP may be connected a $k-1_{th}$ (k is an integer of 2 or more) scan line Sk−1, to a $k_{th}$ scan line Sk, a $k+1_{th}$ scan line Sk+1, and a $j_{th}$ (j is a positive integer) data line Dj. Further, the sub-pixel SP may be connected a first driving voltage line VDDL for supplying a first driving voltage, an initialization voltage line VIL for supplying an initialization voltage Vini, and a second driving voltage line VSSL for supplying a second driving voltage.

The sub-pixel SP includes a first driving transistor DT1, a second driving transistor DT2, a light emitting element LE, switch elements, a capacitor C. and the like. The switch elements include first to sixth transistors ST1, ST2, ST3, ST4, ST5, and ST6.

The first driving transistor DT1 and the second driving transistor DT2 control a drain-source current Ids (hereinafter referred to as "driving current") according to the data voltage applied to the gate electrode. The driving current flowing through the channels of the first driving transistor DT1 and the second driving transistor DT2 is proportional to a square of a difference between a gate-source voltage Vsg and a threshold voltage Vth of the first driving transistor DT1 and the second driving transistor DT2 as shown in Equation 1 below.

$$Ids=k'\times(Vsg-Vth)^2 \quad \text{(Eq. 1)}$$

In Equation 1, k' is a proportional coefficient determined by the structures and physical characteristics of the first driving transistor DT1 and the second driving transistor DT2, Vsg is a gate-source voltage of the first driving transistor DT1 and the second driving transistor DT2, and Vth is a threshold voltage of a driving transistor.

The light emitting element EL emits light in accordance with the driving current Ids. The light emission amount of the light emitting element EL may be proportional to the drive current Ids. The first driving transistor DT1 and the second driving transistor DT2 may be connected in parallel. For example, first electrodes of the first driving transistor DT1 and the second driving transistor DT2 may be connected to each other, second electrodes of the first driving transistor DT1 and the second driving transistor DT2 may be connected to each other, gate electrodes of the first driving transistor DT1 and the second driving transistor DT2 may be connected to each other, and active layers of the first driving transistor DT1 and the second driving transistor DT2 may be located in parallel.

Thus, by providing a dual transistor in which the first driving transistor DT1 and the second driving transistor DT2 are connected in parallel, embodiments of the present disclosure provide a relatively high driving current by increasing the width of the active layer, as compared with the case where one driving transistor is disposed.

The light emitting element EL may be an organic light emitting diode including an anode electrode, a cathode electrode, and an organic light emitting layer disposed between the anode electrode and the cathode electrode.

The light emitting element EL may be an inorganic light emitting element including an anode electrode, a cathode electrode, and an inorganic semiconductor disposed between the anode electrode and the cathode electrode.

The light emitting element EL may be a quantum dot light emitting element including an anode electrode, a cathode electrode, and a quantum dot light emitting layer disposed between the anode electrode and the cathode electrode. Alternatively, the light emitting element EL may be a micro light emitting diode.

The anode electrode of the light emitting element EL may be connected to the first electrode of the fourth transistor ST4 and the second electrode of the sixth transistor ST6, and the cathode electrode thereof may be connected to the second driving voltage line VSSL. A parasitic capacitance Cel may be formed between the anode electrode and cathode electrode of the light emitting element EL.

The first transistor ST1 is turned on by the scan signal of the $k_{th}$ scan line Sk to connect the first electrodes of the first driving transistor DT1 and the second driving transistor DT2 to the $j_{th}$ data line Dj. The gate electrode of the first transistor ST1 may be connected to the $k_{th}$ scan line Sk, the first electrode thereof may be connected to the first electrodes of the first driving transistor DT1 and the second driving transistor DT2, and the second electrode thereof may be connected to the $j_{th}$ data line Dj.

The second transistor ST2 may be formed as a dual transistor including a second-first transistor ST2-1 and a second-second transistor ST2-2. The second-first transistor ST2-1 and the second-second transistor ST2-2 are turned on by a scan signal of the $k_{th}$ scan line Sk to connect the gate electrodes and second electrodes of the first driving transistor DT1 and the second driving transistor DT2. That is, when the second-first transistor ST2-1 and the second-second transistor ST2-2 are turned on, the gate electrodes and second electrodes of the first driving transistor DT1 and the second driving transistor DT2 are connected, and thus the first driving transistor DT1 and the second driving transistor DT2 are driven by diodes.

The gate electrode of the second-first transistor ST2-1 may be connected to the $k_{th}$ scan line Sk, the first electrode thereof may be connected to the second electrode of the second-second transistor ST2-2, and the second electrode thereof may be connected to the gate electrodes of the first driving transistor DT1 and the second driving transistor DT2. The gate electrode of the second-second transistor ST2-2 may be connected to the $k_{th}$ scan line Sk, the first electrode thereof may be connected to the second electrodes of the first driving transistor DT1 and the second driving transistor DT2, and the second electrode thereof may be connected to the first electrode of the second-second transistor ST2-2.

The third transistor ST3 may be formed as a dual transistor including a third-first transistor ST3-1 and a third-second transistor ST3-2. The third-first transistor ST3-1 and the third-second transistor ST3-2 are turned on by a scan signal of the $k-1_{th}$ scan line Sk−1 to connect the gate electrodes of the first driving transistor DT1 and the second driving transistor DT2 to the initialization voltage line VIL. The gate electrodes of the first driving transistor DT1 and the second driving transistor DT2 may be discharged with the initialization voltage of the initialization voltage line VIL.

The gate electrode of the third-first transistor ST3-1 may be connected to the $k-1_{th}$ scan line Sk−1, the first electrode thereof may be connected to the gate electrodes of the first driving transistor DT1 and the second driving transistor DT2, and the second electrode thereof may be connected to the first electrode of the third-second transistor ST3-2. The gate electrode of the third-second transistor ST3-2 may be connected to the $k-1_{th}$ scan line Sk−1, the first electrode thereof may be connected to the second electrode of the third-first transistor ST3-1, and the second electrode thereof may be connected to the initialization voltage line VIL.

The fourth transistor ST4 is turned on by a scan signal of the $k+1_{th}$ scan line Sk+1 to connect the anode electrode of the light emitting element EL to the initialization voltage line VIL. The anode electrode of the light emitting element EL may be discharged with the initialization voltage of the initialization voltage line VIL.

The gate electrode of the fourth transistor ST4 is connected to the $k-+1_{th}$ scan line Sk+1, the first electrode thereof is connected to the anode electrode of the light emitting element EL, and the second electrode thereof is connected to the initialization voltage line VIL.

The fifth transistor ST5 is turned on by a light emission control signal of the $k_{th}$ light emitting line Ek to connect the first electrodes of the first driving transistor DT1 and the second driving transistor DT2 to the first driving voltage line VDDL.

The gate electrode of the fifth transistor ST5 is connected to the $k_{th}$ light emitting line Ek, the first electrode thereof is connected to the first driving voltage line VDDL, and the second electrode thereof is connected to the first electrodes of the first driving transistor DT1 and the second driving transistor DT2.

The sixth transistor ST6 is connected between the second electrodes of the first driving transistor DT1 and the second driving transistor DT2 and the anode electrode of the light emitting element EL. The sixth transistor ST6 is turned on by a light emission control signal of the $k_{th}$ light emitting line Ek to connect the second electrodes of the first driving transistor DT1 and the second driving transistor DT2 to the anode electrode of the light emitting element EL.

The gate electrode of the sixth transistor ST6 is connected to the $k_{th}$ light emitting line Ek, the first electrode thereof is connected to the second electrodes of the first driving transistor DT1 and the second driving transistor DT2, and the second electrode thereof is connected to the anode electrode of the light emitting element EL. When both the fifth transistor ST5 and the sixth transistor ST6 are turned on, the driving current Ids may be supplied to the light emitting element EL.

The capacitor C is formed between the gate electrodes of the first driving transistor DT1 and the second driving transistor DT2 and the first driving voltage line VDDL. One electrode of the capacitor C may be connected to the gate electrodes of the first driving transistor DT1 and the second driving transistor DT2, and the other electrode thereof may be connected to the first driving voltage line VDDL. The capacitor C serves to hold the voltages of the gate electrodes of the first driving transistor DT1 and the second driving transistor DT2 for one frame period.

When the first electrode of each of the first to sixth transistors ST1, ST2, ST3, ST4, ST5, and ST6 and the driving transistors DT1 and DT2 is a source electrode, the second electrode thereof may be a drain electrode. Alternatively, when the first electrode of each of the first to sixth transistors ST1, ST2, ST3, ST4, ST5, and ST6 and the driving transistors DT1 and DT2 is a drain electrode, the second electrode thereof may be a source electrode.

The active layer of each of the first to sixth transistors ST1, ST2, ST3, ST4, ST5, and ST6 and the driving transistors DT1 and DT2 may be formed of any one of polysilicon, amorphous silicon, and an oxide semiconductor. When the active layer of each of the first to sixth transistors ST1, ST2, ST3, ST4, ST5, and ST6 and the driving transistors DT1 and DT2 may be formed of polysilicon, the process of forming the active layer may be a low-temperature polysilicon (LTPS) process.

Although in FIG. 4 the first to sixth transistors ST1, ST2, ST3, ST4, ST5, and ST6 and the driving transistors DT1 and DT2 are formed of P-type metal oxide semiconductor field effect transistors (MOSFETs), the present invention is not limited thereto, and they may be formed of N-type MOSFETs. When the first to sixth transistors ST1, ST2, ST3, ST4, ST5, and ST6 and the driving transistors DT1 and DT2 are formed of N-type MOSFETs, the timing diagram of FIG. 5 should be modified in accordance with the characteristics of the N-type MOSFETs.

The first driving voltage of the first driving voltage line VDDL, the second driving voltage of the second driving voltage line VSSL, and the initialization voltage of the initialization voltage line Vini may be set in consideration of the characteristics of the first driving transistor DT1 and the second driving transistor DT2 and the characteristics of the light emitting element EL. For example, a voltage difference between the initialization voltage and the data voltage supplied to the source electrodes of the first driving transistor DT1 and the second driving transistor DT2 may be set to be smaller than the threshold voltage of each of the first driving transistor DT1 and the second driving transistor DT2.

Figure 5:
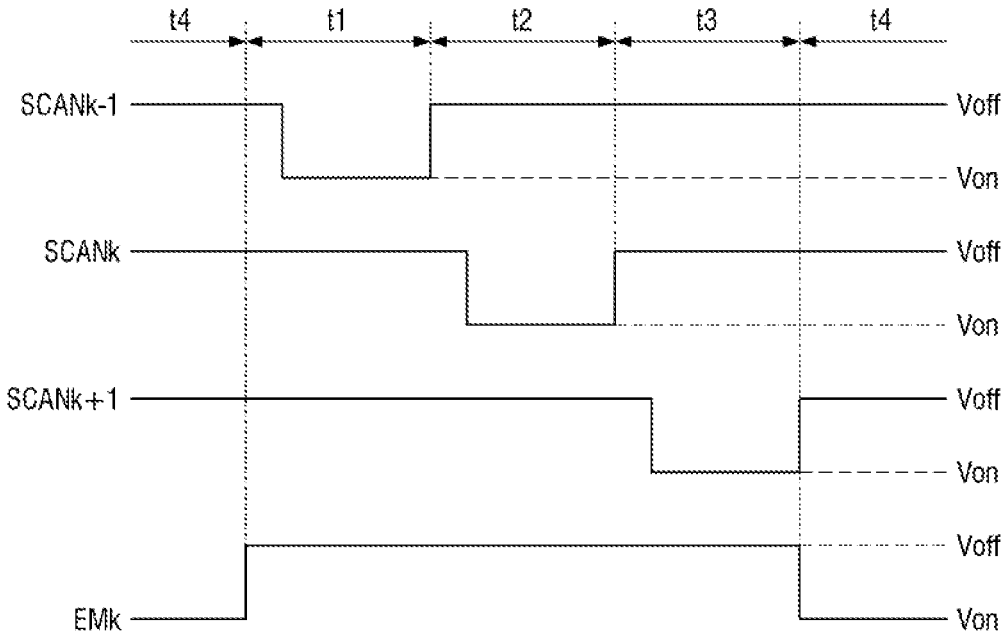
FIG. 5 is a waveform diagram of signals applied to the $k-1_{th}$ scan line, $k_{th}$ scan line, $k+1_{th}$ scan line, and $k_{th}$ light emitting line of FIG. 4.

FIG. 5 is a waveform diagram of signals applied to the $k-1_{th}$ scan line, $k_{th}$ scan line, $k+1_{th}$ scan line, and $k_{th}$ light emitting line of FIG. 4.

Referring to FIG. 5, the $k-1_{th}$ scan signal SCANk−1 applied to the $k-1_{th}$ scan line Sk−1 is a signal for controlling the turn-on and turn-off of the third transistor ST3. The km scan signal SCANk applied to the k scan line Sk is a signal for controlling the turn-on and turn-off of each of the first transistor ST1 and the second transistor ST2. The $k+1_{th}$ scan signal SCANk+1 applied to the $k+1_{th}$ scan line Sk+1 is a signal for controlling the turn-on and turn-off of the fourth transistor ST4. The $k_{th}$ light emission signal EMk is a signal for controlling the fifth transistor ST5 and the sixth transistor ST6.

The $k-1_{th}$ scan signal SCANk−1, the $k_{th}$ scan signal SCANk, the $k+1_{th}$ scan signal SCANk+1, and $k_{th}$ light emission signal Emk may be generated at intervals of one frame period. One frame period may be divided into first to fourth periods t1 to t4. The first period t1 is a period for initializing the gate electrodes of the first driving transistor DT1 and the second driving transistor DT2, the second period t2 may be a period for supplying data voltages to the gate electrodes of the first driving transistor DT1 and the second driving transistor DT2 and sampling the threshold voltages of the first driving transistor DT1 and the second driving transistor DT2, the third period t3 is a period for initializing the anode electrode of the light emitting element EL, and the fourth period t4 is a period for emitting light from the light emitting element EL.

The $k-1_{th}$ scan signal SCANk−1, the $k_{th}$ scan signal SCANk, and the $k+1_{th}$ scan signal SCANk+1 may be sequentially output with gate-on voltages Von during the first to third periods t1, t2, and t3. For example, the $k-1_{th}$ scan signal SCANk−1 may have a gate-on voltage Von during the first period t1, and may have a gate-off voltage Voff during residual periods. The $k_{th}$ scan signal SCANk may have a gate-on voltage Von during the second period t2, and may have a gate-off voltage Voff during residual periods. The $k+1_{th}$ scan signal SCANk+1 may have a gate-on voltage Von during the third period t3, and may have a gate-off voltage Voff during residual periods. Although it is illustrated in FIG. 5 that the period during which the $k-1_{th}$ scan signal SCANk−1 has a gate-on voltage Von is shorter than the first period t1, the period during which the k−1, scan signal SCANk−1 has a gate-on voltage Von may be substantially equal to the first period t1. Further, although illustrated in FIG. 5 that the period during which the $k_{th}$ scan signal SCANk has a gate-on voltage Von is shorter than the second period t2, the period during which the $k_{th}$ scan signal SCANk has a gate-on voltage Von may be substantially equal to the second period t2. Further, although illustrated in FIG. 5 that the period during which the $k+1_{th}$ scan signal SCANk+1 has a gate-on voltage Von is shorter than the third period t3, the period during which the $k+1_{th}$ scan signal SCANk+1 has a gate-on voltage Von may be substantially equal to the third period t3.

The $k_{th}$ light emission signal EMk may have a gate-on voltage Von during the fourth period t4 and may have a gate-off voltage Voff during residual periods.

It is shown in FIG. 5 that each of the first period t1, the second period t2, and the third period t3 is one horizontal period. Since one horizontal period indicates a period during which a data voltage is supplied to each of the sub-pixels SP connected to any scan line of the display panel 100, FIG. 5 may be defined as one horizontal line scan period. The data voltages may be supplied to the data lines DL in synchronization with the gate-on voltages Von of the respective scan signals.

The gate-on voltage corresponds to a turn-on voltage capable of turning on each of the first to sixth transistors ST1, ST2, ST3, ST4, ST5, and ST6. The gate-off voltage corresponds to a turn-off voltage capable of turning off each of the first to sixth transistors ST1, ST2, ST3, ST4, ST5, and ST6.

FIGS. 6 to 9 are circuit diagrams showing a method of driving a first sub-pixel during first to fifth periods of FIG. 5.

Hereinafter, an operation of the sub-pixel SP during the first to fourth periods t1 to t4 will be described in detail with reference to FIGS. 5 to 9.

Figure 6:
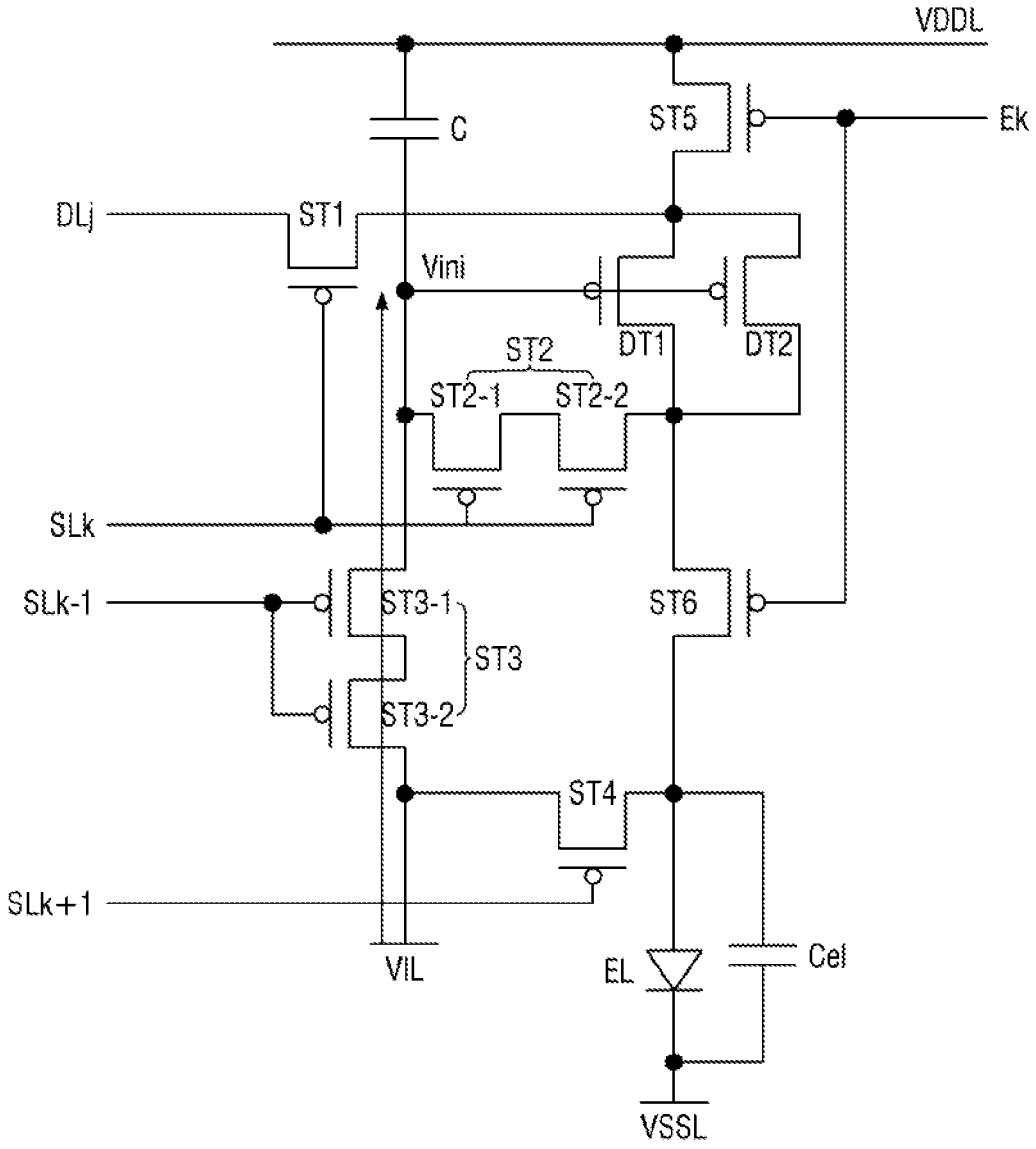
FIGS. 6 to 9 are circuit diagrams showing a method of driving a first sub-pixel during first to fifth periods of FIG. 5.

First, the $k-1_{th}$ scan signal SCANk−1 having a gate-on voltage Von is supplied to the $k-1_{th}$ scan line Sk−1 during the first period t1. During the first period t1, the third transistor ST3 is turned on by the $k-1_{th}$ scan signal SCANk−1 having a gate-on voltage Von as shown in FIG. 6. When the third transistor ST3 is turned on, the gate electrodes of the first driving transistor DT1 and the second driving transistor DT2 are initialized by the initialization voltage Vini of the initialization voltage line VIL.

Figure 7:
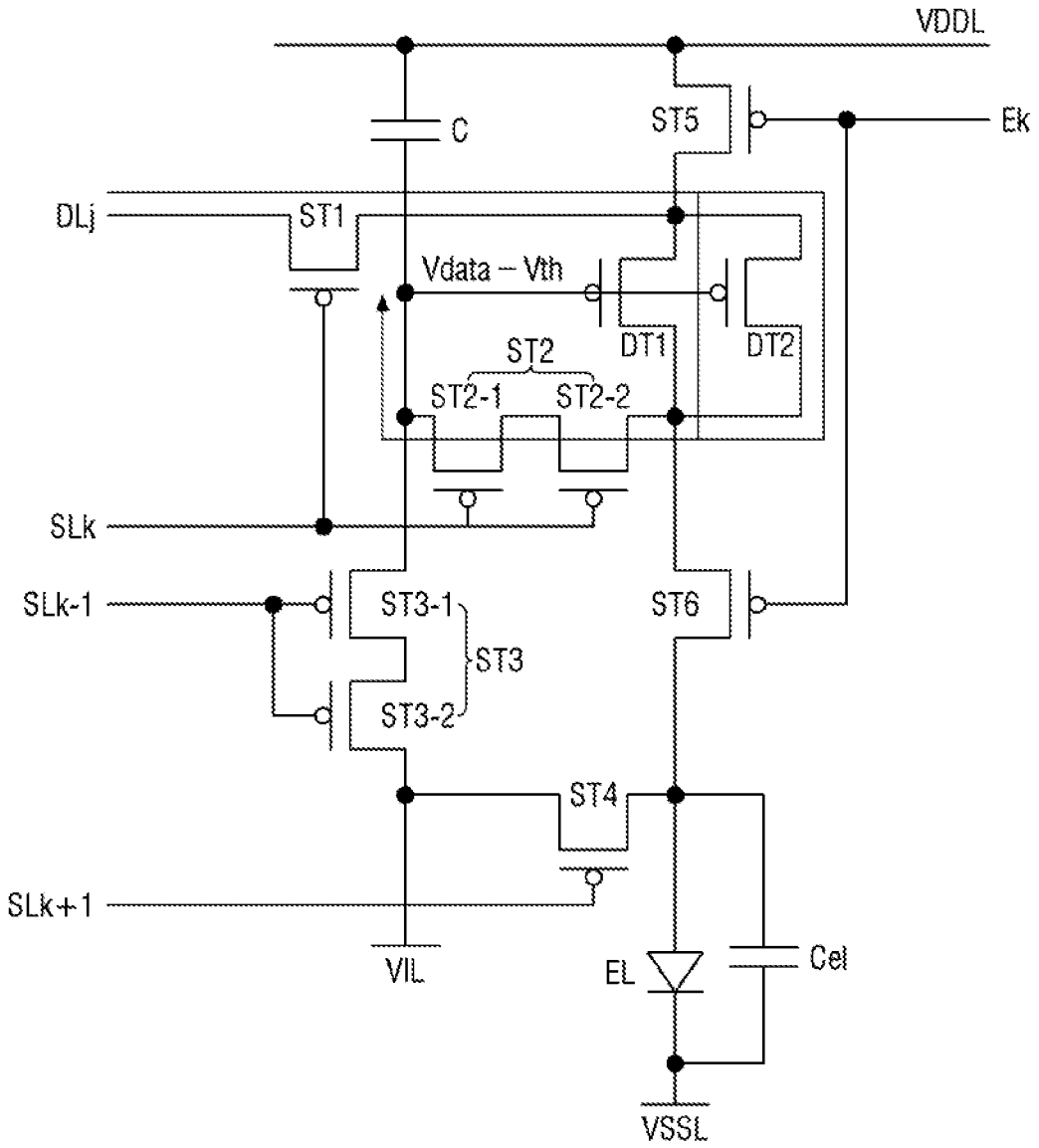

Second, the $k_{th}$ scan signal SCANk having a gate-on voltage Von is supplied to the $k_{th}$ scan line Sk during the second period t2. During the second period t2, each of the first transistor ST1 and the second transistor ST2 is turned on by the $k_{th}$ scan signal SCANk having a gate-on voltage Von as shown in FIG. 7.

When the second transistor ST2 is turned on, the gate electrodes and second electrodes of the first driving transistor DT1 and the second driving transistor DT2 are connected to each other, and the first driving transistor DT1 and the second driving transistor DT2 are driven by diodes. When the first transistor ST1 is turned on, a data voltage Vdata is supplied to the first electrodes of the first driving transistor DT1 and the second driving transistor DT2. In this case, since the voltage difference (Vsg=Vdata−Vini) between the gate electrode and first electrode of each of the first driving transistor DT1 and the second driving transistor DT2 is larger than the threshold voltage Vth, the first driving transistor DT1 and the second driving transistor DT2 form a current path until the voltage difference Vsg between the gate electrode and the source electrode reaches the threshold voltage Vth. Thus, the voltage of each of the gate electrode and second electrode of each of the first driving transistor DT1 and the second driving transistor DT2 increases up to a differential voltage (Vdata-Vth) between the data voltage Vdata and the threshold voltage Vth of each of the first driving transistor DT1 and the second driving transistor DT2. The "differential voltage (Vdata-Vth)" may be stored in the capacitor C.

Figure 8:
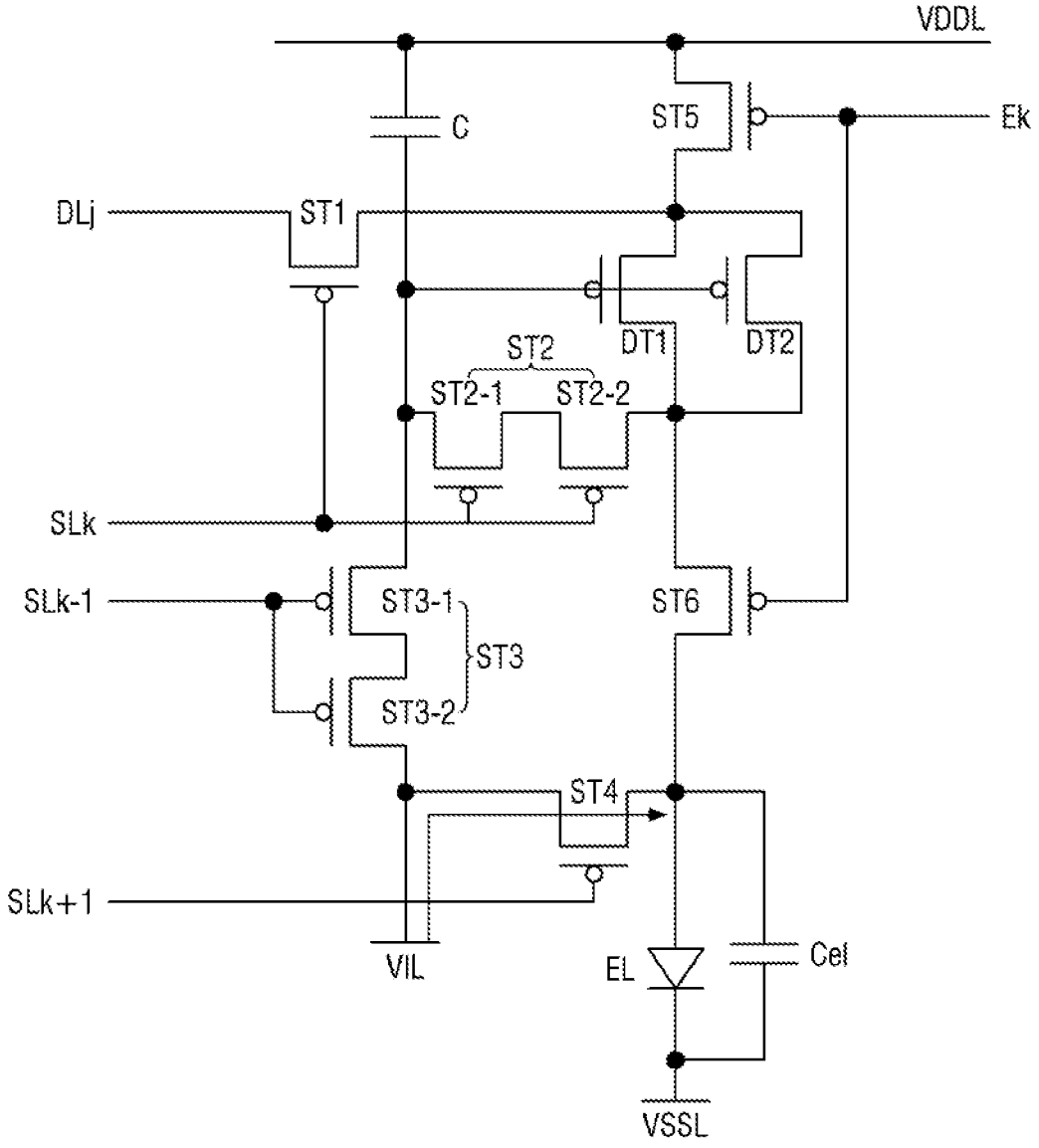

Third, the $k+1_{th}$ scan signal SCANk+1 having a gate-on voltage Von is supplied to the $k+1_{th}$ scan line Sk+1 during the third period t3. During the third period t3, the fourth transistor ST4 is turned on by the $k+1_{th}$ scan signal SCANk+1 having a gate-on voltage Von as shown in FIG. 8. When the fourth transistor ST4 is turned on, the anode electrodes of the light emitting element EL is initialized by the initialization voltage Vini of the initialization voltage line VIL.

Figure 9:
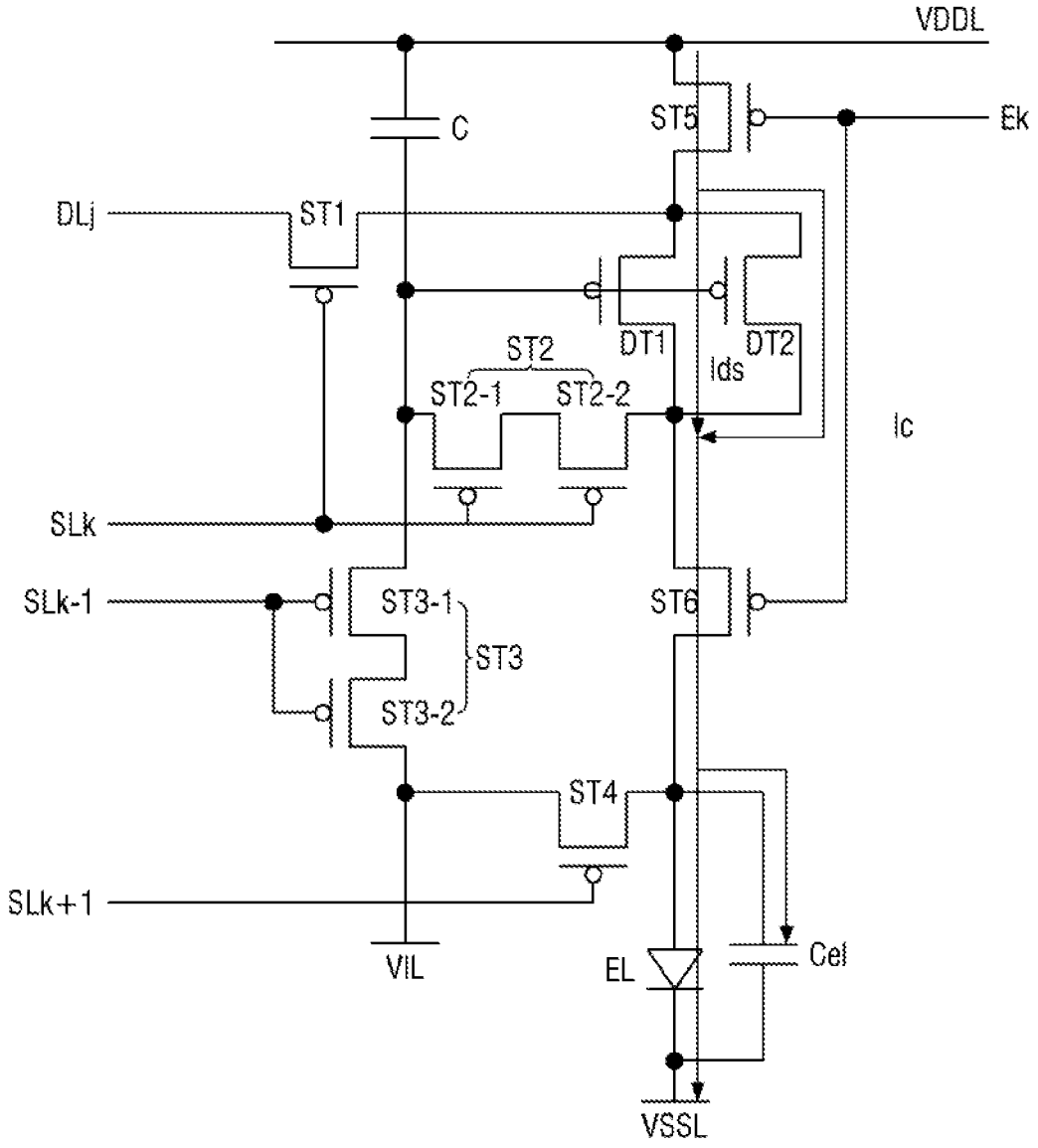

Fourth, the $k_{th}$ light emission signal EMk having a gate-on voltage Von is supplied to the $k_{th}$ light emitting line Ek during the fourth period t4. During the fourth period t4, each of the fifth transistor ST5 and the sixth transistor ST6 is turned on by the $k_{th}$ light emission signal EMk having a gate-on voltage Von as shown in FIG. 9.

When the fifth transistor ST5 is turned on, the first electrodes of the first driving transistor DT1 and the second driving transistor DT2 are connected to the first driving voltage line VDDL. When the sixth transistor ST6 is turned on, the second electrodes of the first driving transistor DT1 and the second driving transistor DT2 are connected to the anode electrode of the light emitting element EL.

When the fifth transistor ST5 and the sixth transistor ST6 are turned on, the driving current Ids flowing according the voltages of the gate electrodes of the first driving transistor DT1 and the second driving transistor DT2 may be supplied to the light emitting element EL. The driving current Ids may be defined by Equation 2 below.

$$Ids=k'\times(ELVDD-(V\text{data}-Vth)-Vth)^2 \quad \text{(Eq. 2)}$$

In Equation 2, k' is a proportional coefficient determined by the structures and physical characteristics of the first driving transistor DT1 and the second driving transistor DT2, Vth is a threshold voltage of each of the first driving transistor DT1 and the second driving transistor DT2, ELVDD is a first driving voltage of the first driving voltage line VDDL, and Vdata is a data voltage. The gate voltages of each of the first driving transistor DT1 and the second driving transistor DT2 is Vdata−Vth, and the voltage of the first electrode is ELVDD.

Summarizing Equation 2, Equation 2 is derived.

$$Ids=k'\times(ELVDD-V\text{data})^2 \quad \text{(Eq. 3)}$$

Consequently, as shown in Equation 3, the driving current Ids does not depend on the threshold voltage Vth of each of the first driving transistor DT1 and the second driving transistor DT2. That is, the threshold voltage Vth of each of the first driving transistor DT1 and the second driving transistor DT2 is compensated.

Meanwhile, as shown in FIG. 9, the driving current Ids is supplied not only to the light emitting element EL but also to the parasitic capacitance Cel. However, in the case of a dual transistor in which the driving transistors DT1 and DT2 are connected in parallel, a high driving current Ids may be supplied, so that the light emitting element EL may be driven at a high luminance, and the charging time of the parasitic capacitance Cel may be reduced.

Figure 10:
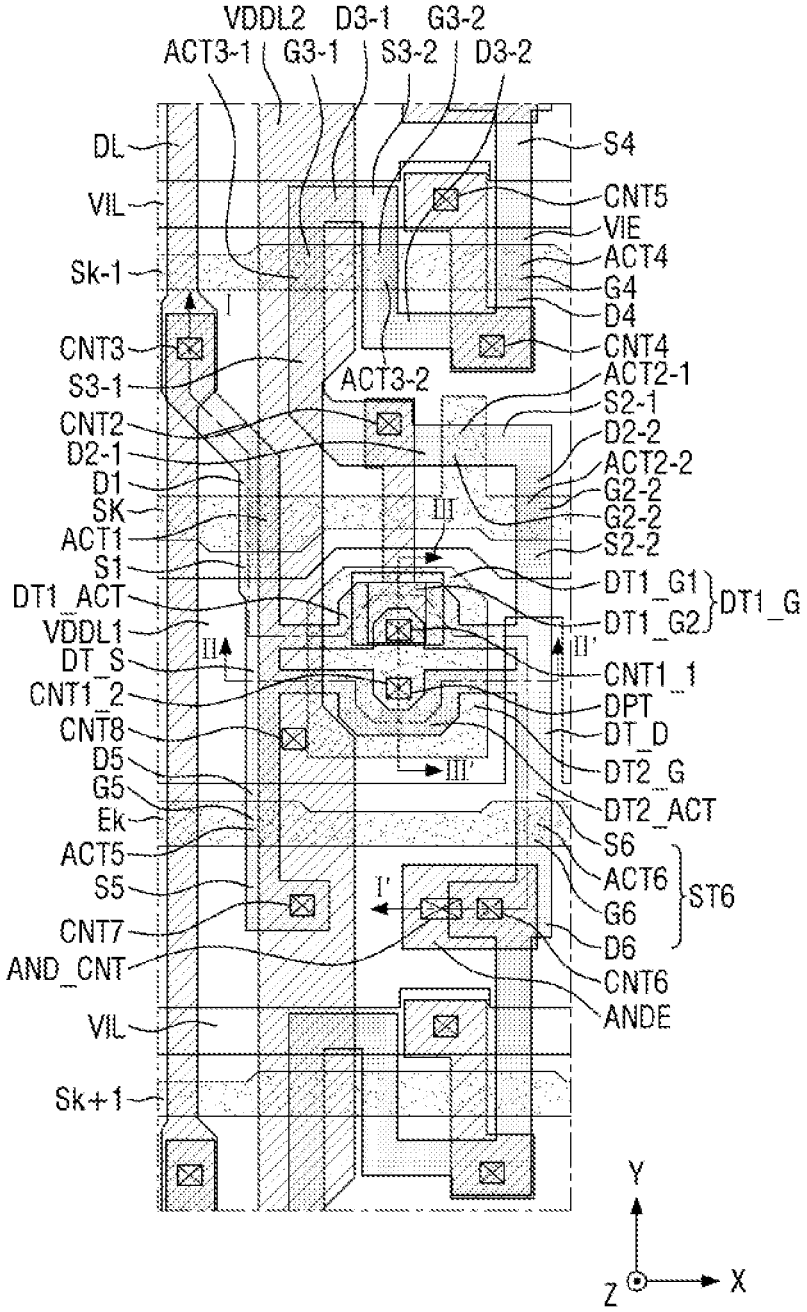
FIG. 10 is a detailed plan view of a sub-pixel according to an embodiment.
Figure 11:
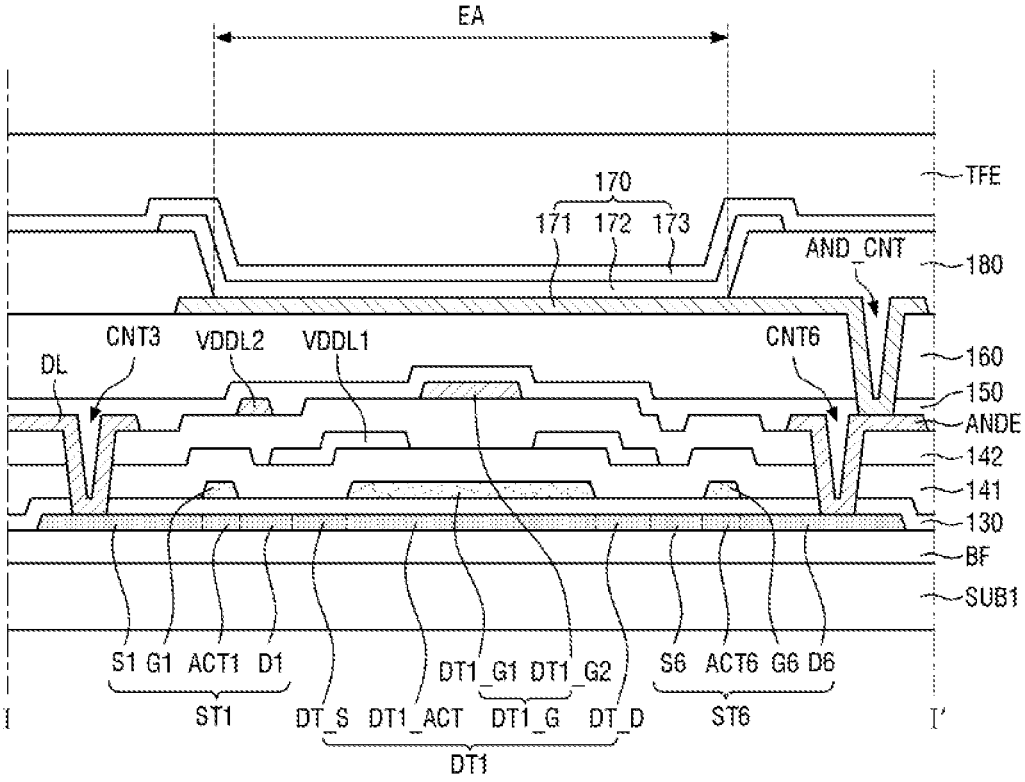
FIG. 11 is a cross-sectional view taken along the line I-I' of FIG. 10.
Figure 12:
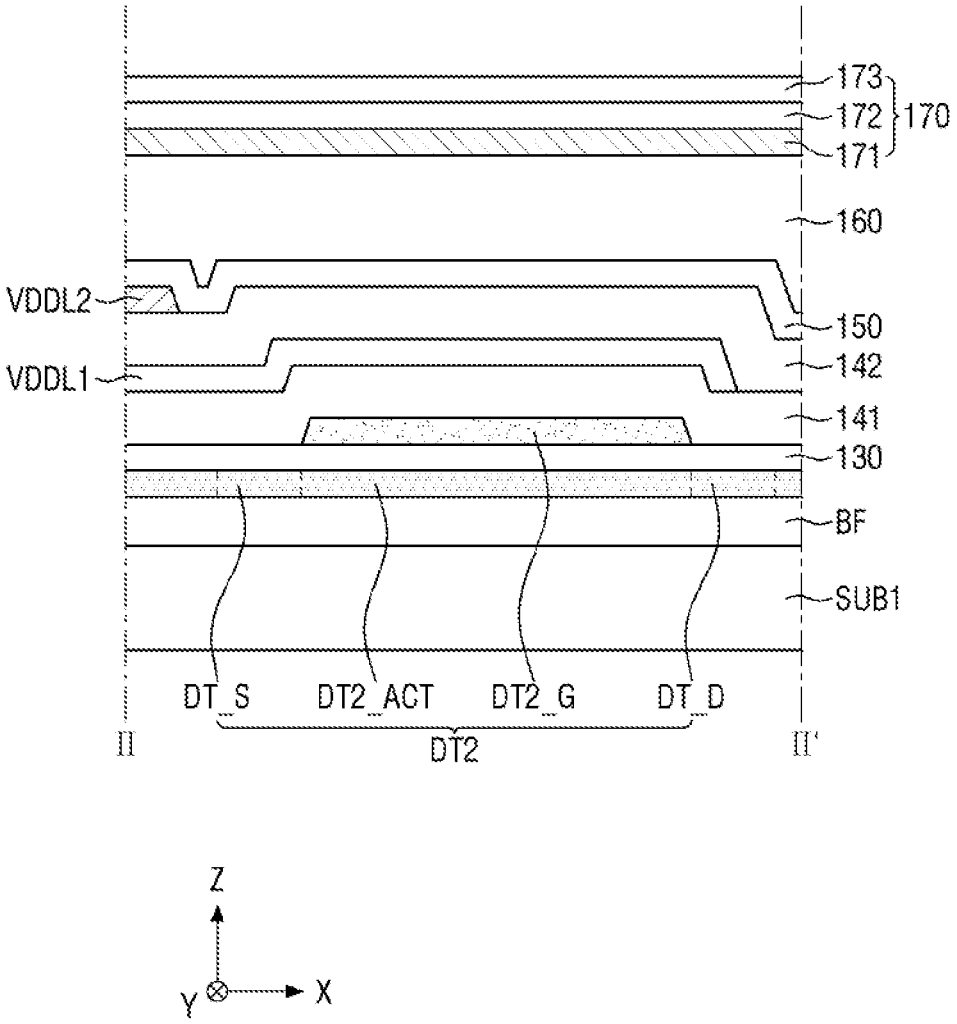
FIG. 12 is a cross-sectional view taken along the line II-II' of FIG. 10.
Figure 13:
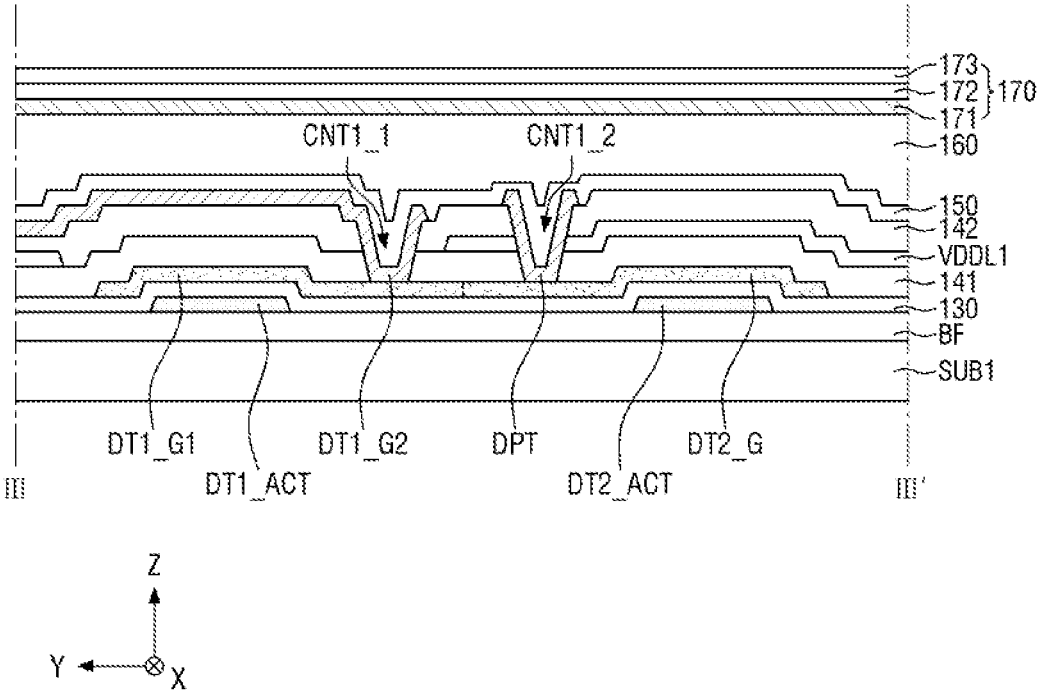
FIG. 13 is a cross-sectional view taken along the line III-III' of FIG. 10.

FIG. 10 is a detailed plan view of a sub-pixel according to an embodiment, FIG. 11 is a cross-sectional view taken along the line I-I' of FIG. 10, FIG. 12 is a cross-sectional view taken along the line II-II' of FIG. 10, and FIG. 13 is a cross-sectional view taken along the line III-III' of FIG. 10.

Referring to FIGS. 10 to 13, the sub-pixel SP may include a first driving transistor DT1, a second driving transistor DT2, first to sixth transistors ST1 through ST6, and a capacitor C.

The first driving transistor DT1 may include a first active layer DT1_ACT, a first gate electrode DT1_G, a first electrode DT_S, and a second electrode DT_D. The first active layer DT1_ACT of the first driving transistor DT1 may overlap the first gate electrode DT1_G of the first driving transistor DT1. The first gate electrode DT1_G of the first driving transistor DT1 may include a first-first gate electrode DT1_G1 and a first-second gate electrode DT1_G2. The first-second gate electrode DT1_G2 may be disposed on the first-first gate electrode DT1_G1, and the first-first gate electrode DT1_G1 and the first-second gate electrode DT1_G2 may be connected to each other through a first-first contact hole CNT1_1. The first-first gate electrode DT1_G1 may overlap the first active layer DT1_ACT of the first driving transistor DT1, and the first-second driving gate electrode DT1_G2 may be connected to the second electrode D2-1 of the second-first transistor ST2-1 through a second contact hole CNT2. The first electrode DT_S of the first driving transistor DT1 may be connected to the first electrode S of the first transistor ST1. The second electrode DT_D of the first driving transistor DT1 may be connected to the first electrode S2-1 of the second-second transistor ST2-2 and the first electrode S6 of the sixth transistor ST6.

The second driving transistor DT2 may include a second active layer DT2_ACT, a second gate electrode DT2_G, a first electrode DT_S, and a second electrode DT1_D. As described above, the first electrode DT_S and second electrode DT_D of the second driving transistor DT_2 may be configured to be connected to the first electrode DT_S and second electrode DT_D of the first driving transistor DT1. That is, the first driving transistor DT1 and the second driving transistor DT2 may be configured to share the first electrode DT_S and the second electrode DT_D.

The second active layer DT2_ACT of the second driving transistor DT2 may overlap the second gate electrode DT2_G of the second driving transistor DT2. In some embodiments, the second active layer DT2_ACT may have the same size and shape as the first active layer DT1_ACT and may be symmetrical with the first active layer DT1_ACT in a direction opposite to the second direction (Y-axis direction). Illustratively, the first active layer DT1_ACT may be disposed to be bent in the second direction (Y-axis direction), and the second active layer DT2_ACT may be disposed to be bent in a direction opposite to the second direction (Y-axis direction).

A first-second contact hole CNT1_2 may be disposed on the second gate electrode DT2_G between the second active layer DT2_ACT and the first-first contact hole CNT1_1 in the second direction (Y-axis direction). Illustratively, the first-first contact hole CNT1_1 may be located adjacent to the first active layer DT1_ACT and expose the first-first gate electrode DT1_G1, and the first-second contact hole CNT1_2 may be located adjacent to the second active layer DT2_ACT and expose the second gate electrode DT2_G.

The first active layer DT1_ACT, the first-first contact hole CNT1_1, the first-second contact hole CNT1_2, and the second active layer DT2_ACT may be sequentially arranged in a direction opposite to the second direction (Y-axis direction).

The first-first contact hole CNT1_1 and the first-second contact hole CNT1_2 may be symmetrical to each other with respect to the boundary between the first-first gate electrode DT1_G1 and the second gate electrode DT2_G. The first-first contact hole CNT1_1 and the first-second contact hole CNT1_2 may overlap each other in the second direction (Y-axis direction). As described above, the first-first contact hole CNT1_1 and the first-second contact hole CNT1_2 may be symmetrical to each other with respect to the boundary between the first-first gate electrode DT1_G1 and the second gate electrode DT2_G, thereby minimizing the characteristic deviation between the first active layer DT1_ACT of the first driving transistor DT1 and the second active layer DT2_ACT of the second driving transistor DT2. Accordingly, it is possible to prevent the deterioration of image quality due to a difference in characteristics between the first driving transistor DT1 and the second driving transistor DT2.

In some embodiments, unlike the first gate electrode DT1_G of the second driving transistor DT2, the second gate electrode DT2_G of the second driving transistor DT2 may have a single-layer structure. Further, the second gate electrode DT2_G of the second driving transistor DT2 may be configured to be connected to the first-first gate electrode DT1_G1. For example, the second gate electrode DT2_G and the first-first gate electrode DT1_G1 may be formed integrally. However, the present invention is not limited thereto. The second gate electrode DT2_G and the first-first gate electrode DT1_G1 may be spaced apart from each other but may be electrically connected to each other through a connection pattern. A dummy pattern DPT may be provided in the first-second contact hole CNT1_2 to be in contact with the second gate electrode DT2_G exposed through the first-second contact hole CNT1_2. The dummy pattern DPT may be made of the same material as the first-second gate electrode DT1_G2 and may be disposed on the same layer as the first-second gate electrode DT1_G2.

The second gate electrode DT2_G may overlap the second active layer DT2_ACT of the second driving transistor DT2, and the first electrode DT_S of the second driving transistor DT2 may be connected to the first electrode S1 of the first transistor ST1. The second electrode DT_D of the second driving transistor DT2 may be connected to the first electrode S2-1 of the second-second transistor ST2-2 and the first electrode S6 of the sixth transistor ST6.

The first transistor ST1 may include an active layer ACT1, a gate electrode G1, a first electrode S1, and a second electrode D1. The gate electrode G1 of the first transistor ST1, which is a part of the $k_{th}$ scan line Sk (k is a positive integer of 2 or more), may be a region in which the active layer ACT1 of the first transistor ST1 overlaps the $k_{th}$ scan line Sk. The first electrode S1 of the first transistor ST1 may be connected to the first electrodes DT_S of the first driving transistor DT1 and the second driving transistor DT2. The second electrode D1 of the first transistor ST may be connected to the $j_{th}$ data line Dj through a third contact hole CNT3.

The second transistor ST2 may be formed as a dual transistor. The second transistor ST2 may include a second-first transistor ST2-1 and a second-second transistor ST2-2.

The second-first transistor ST2-1 may include an active layer ACT2-1, a gate electrode G2-1, a first electrode S2-1, and a second electrode D2-1. The gate electrode G2-1 of the second-first transistor ST2-1, which is a part of the $k_{th}$ scan line Sk, may be a region in which the active layer ACT2-1 of the second-first transistor ST2-1 overlaps the $k_{th}$ scan line Sk. The first electrode S2-1 of the second-first transistor ST2-1 may be connected to the second electrode S2-2 of the second-second transistor ST2-2. The second electrode D2-1 of the second-first transistor ST2-1 may be connected to the first-second gate electrode DT1_G2 of the first driving transistor DT1 through the second contact hole CNT2.

The second-second transistor ST2-2 may include an active layer ACT2-2, a gate electrode G2-2, a first electrode S2-2, and a second electrode D2-2. The gate electrode G2-2 of the second-second transistor ST2-2, which is a part of the $k_{th}$ scan line Sk, may be a region in which the active layer ACT2-2 of the second-second transistor ST2-2 overlaps the $k_{th}$ scan line Sk. The first electrode S2-2 of the second-second transistor ST2-2 may be connected to the second electrodes DT_D of the first driving transistor DT1 and the second driving transistor DT2. The second electrode D2-2 of the second-second transistor ST2-2 may be connected to the first electrode S2-1 of the second-first transistor ST2-1.

The third transistor ST3 may be formed as a dual transistor. The third transistor ST3 may include a third-first transistor ST3-1 and a third-second transistor ST3-2.

The third-first transistor ST3-1 may include an active layer ACT3-1, a gate electrode G3-1, a first electrode S3-1, and a second electrode D3-1. The gate electrode G3-1 of the third-first transistor ST3-1, which is a part of the $k-1_{th}$ scan line Sk−1, may be a region in which the active layer ACT3-1 of the third-first transistor ST3-1 overlaps the $k-1_{th}$ scan line Sk−1. The first electrode S3-1 of the third-first transistor ST3-1 may be connected to the first-second gate electrode DT_G2 of the first driving transistor DT1 through the second contact hole CNT2. The second electrode D3-1 of the third-first transistor ST3-1 may be connected to the first electrode S3-2 of the third-second transistor ST3-2.

The third-second transistor ST3-2 may include an active layer ACT3-2, a gate electrode G3-2, a first electrode S3-2, and a second electrode D3-2. The gate electrode G3-2 of the third-second transistor ST3-2, which is a part of the $k-1_{th}$ scan line Sk−1, may be a region in which the active layer ACT3-2 of the third-second transistor ST3-2 overlaps the $k-1_{t}$, scan line Sk−1. The first electrode S3-2 of the third-second transistor ST3-2 may be connected to the first-second gate electrode DT_G2 of the first driving transistor DT1 through the second contact hole CNT2. The second electrode D3-2 of the third-second transistor ST3-2 may be connected to an initialization connection electrode VIE through a fourth contact hole CNT4.

The fourth transistor ST4 may include an active layer ACT4, a gate electrode G4, a first electrode S4, and a second electrode D4. The gate electrode G4 of the fourth transistor ST4, which is a part of the $k+1_{th}$ scan line Sk+1, may be a region in which the active layer ACT4 of the fourth transistor ST4 overlaps the $k+1_{th}$ scan line Sk+1. The first electrode S4 of the fourth transistor ST4 may be connected to an anode connection electrode ANDE through a sixth contact hole CNT6. The anode electrode AND of the light emitting element may be connected to the anode connection electrode ANDE through an anode contact hole AND_CNT. The second electrode D4 of the fourth transistor ST4 may be connected to the initialization connection electrode VIE through the fourth contact hole CNT4. The initialization voltage line VIL may be connected to the initialization connection electrode VIE through the fifth contact hole CNT5, and the initialization connection electrode VIE may be connected to the second electrode D3-2 of the third-second transistor ST3-2 and the second electrode D4 of the fourth transistor ST4 through the fourth contact hole CNT4. The initialization connection electrode VIE may be disposed to cross the $k-1_{th}$ scan line Sk−1.

The fifth transistor ST5 may include an active layer ACT5, a gate electrode G5, a first electrode S5, and a second electrode D5. The gate electrode G5 of the fifth transistor ST5, which is a part of the $k_{th}$ light emission control line Ek, may be a region in which the active layer ACT5 of the fifth transistor ST5 overlaps the $k_{th}$ light emission control line Ek. The first electrode S5 of the fifth transistor ST5 may be connected to the first-second driving voltage line VDDL2 through a seventh contact hole CNT7. The second electrode D5 of the fifth transistor ST5 may be connected to the first electrodes DT_S of the first driving transistor DT1 and the second driving transistor DT2.

The sixth transistor ST6 may include an active layer ACT6, a gate electrode G6, a first electrode S6, and a second electrode D6. The gate electrode G6 of the sixth transistor ST6, which is a part of the $k_h$ light emission control line Ek, may be a region in which the active layer ACT6 of the sixth transistor ST6 overlaps the $k_{th}$ light emission control line Ek. The first electrode S6 of the sixth transistor ST6 may be connected to the second electrodes DT_D of the first driving transistor DT1 and the second driving transistor DT2. The second electrode D6 of the sixth transistor ST6 may be connected to the anode electrode of the light emitting element through the sixth contact hole CNT6.

The first electrode of the capacitor C may be the same as the first-first gate electrode DT_G1 of the first driving transistor DT1 and the second gate electrode DT2_G of the second driving transistor DT2, and the second electrode of the capacitor C may be a first-first driving voltage line VDDL1 overlapping the first-first gate electrode DT_G1 of the first driving transistor DT1 and the second gate electrode DT2_G of the second driving transistor DT2.

A cross-sectional structure of a sub-pixel according to an embodiment will be described with reference to FIGS. 11 to 13 and FIG. 10. A buffer film BF may be disposed on one surface of a first substrate SUB1 and may be disposed on one surface of the first substrate SUB1 to protect the thin film transistors DT1, DT2, ST1, ST2, ST3, ST4, ST5, and ST6 and the light emitting layer 172 of the light emitting element 170 from moisture permeating through the first substrate SUB1 vulnerable to moisture permeation. The buffer film BF may also be formed of a plurality of alternately laminated inorganic films. For example, the buffer film BF may be a multi-layer film in which two or more of a silicon nitride layer, a silicon oxynitride layer, a silicon oxide layer, a titanium oxide layer, and an aluminum oxide layer are alternately laminated. The buffer film BF may be omitted.

An active layer may be disposed on the first substrate SUB1 or the buffer film BF and may include polycrystalline silicon, monocrystalline silicon, low-temperature polycrystalline silicon, amorphous silicon, or an oxide semiconductor.

In the case where the active layer includes polycrystalline silicon, when the active layer is doped with ions, the active layer doped with ions may have conductivity. Thus, the active layer may include not only active layers DT1_ACT, DT2_ACT, and ACT1 to ACT6 of the first driving transistor DT1, the second driving transistor DT2, and the first to sixth switching transistors ST1 to ST6 but also source electrodes DT_S, S1, S2-1, S2-2, S3-1, S3-2, S4, S5, and S6 and drain electrodes DT_D, D1, D2-1, D2-2, D3-1, D3-2, D4, D5, and D6.

A gate insulating film 130 may be disposed on the active layer and may include an inorganic layer such as a silicon nitride layer, a silicon oxynitride layer, a silicon oxide layer, a titanium oxide layer, or an aluminum oxide layer.

A gate layer may be disposed on the gate insulating film 130. The gate layer may include not only gate electrodes DT1_G1, DT2_G, and G1 to G6 of the first driving transistor DT1, the second driving transistor DT2, and the first to sixth switching transistors ST1 to ST6 but also scan lines Sk−1, Sk, and Sk+1 and light emission control lines Ek. The gate layer may be a single layer or a multi-layer including molybdenum (Mo), aluminum (Al), chromium (Cr), gold (Au), titanium (Ti), nickel (Ni), neodymium (Nd), copper (Cu), or an alloy thereof.

A first interlayer insulating film 141 may be disposed on the gate layer and may include an inorganic layer such as a silicon nitride layer, a silicon oxynitride layer, a silicon oxide layer, a titanium oxide layer, or an aluminum oxide layer. In some embodiments, the first interlayer insulating film 141 may include a plurality of inorganic films.

An initialization voltage line VIL and a first-first driving voltage line VDDL1 may be disposed on the first interlayer insulating film 141. Each of the initialization voltage line VIL and the first-first driving voltage line VDDL1 may be a single layer or a multi-layer including molybdenum (Mo), aluminum (Al), chromium (Cr), gold (Au), titanium (Ti), nickel (Ni), neodymium (Nd), copper (Cu), or an alloy thereof.

A second interlayer insulating film 142 may be disposed on the initialization voltage line VIL and the first-first driving voltage line VDDL1. The second interlayer insulating film 142 may include an inorganic layer such as a silicon nitride layer, a silicon oxynitride layer, a silicon oxide layer, a titanium oxide layer, or an aluminum oxide layer. In some embodiments, the second interlayer insulating film 142 may include a plurality of inorganic films.

A data metal layer may be disposed on the second interlayer insulating film 142. The data metal layer may include data lines DL, first-second driving voltage lines VDDL2, and the first-second gate electrode DT1_G2, anode connection electrode ANDE, initialization connection electrode VIE of the first driving transistor DT1. The data metal layer may be a single layer or a multi-layer including molybdenum (Mo), aluminum (Al), chromium (Cr), gold (Au), titanium (Ti), nickel (Ni), neodymium (Nd), copper (Cu), or an alloy thereof.

A planarization film 160 for planarizing a step may be disposed on the data metal layer. The planarization film 160 may be an organic film including an acrylic resin, an epoxy resin, a phenolic resin, a polyamide resin, or a polyimide resin.

In some embodiments, a protective layer 150 may be additionally disposed between the data metal layer and the planarization film 160. The protective layer 150 may include an inorganic layer such as a silicon nitride layer, a silicon oxynitride layer, a silicon oxide layer, a titanium oxide layer, or an aluminum oxide layer.

Although exemplified that the first driving transistor DT1, the second driving transistor DT2, and the first to sixth transistors ST1 to ST6 are formed by a top gate method in which a gate electrode is located over an active layer, the present invention is not limited thereto. That is, the first driving transistor DT1, the second driving transistor DT2, and the first to sixth transistors ST1 to ST6 may be formed by a bottom gate method in which a gate electrode is located under an active layer or a double gate method in which gate electrodes are located over and under an active layer.

As shown in FIG. 13, the first-first contact hole CNT1_1 may be a hole that penetrates the first interlayer insulating film 141 and the second interlayer insulating film 142 to expose the first-first gate electrode DT1_G1 of the first driving transistor DT1. The first-second gate electrode DT1_G2 of the first driving transistor DT1 may be connected to the first-first gate electrode DT1_G1 of the first driving transistor DT1 through the first-first contact hole CNT1_1. The first-second contact hole CNT1_2 may be a hole that penetrates the first interlayer insulating film 141 and the second interlayer insulating film 142 to expose the second gate electrode DT2_G of the second driving transistor DT2. The dummy pattern DPT may be connected to the second gate electrode DT2_G of the second driving transistor DT2 through the first-second contact hole CNT1_2. The first-first contact hole CNT1_1 and the first-second contact hole CNT1_2 may not overlap the first active layer DT1_ACT and the second active layer DT2_ACT in the third direction (Z-axis direction). However, the present invention is not limited thereto. In some embodiments, the first-first contact hole CNT1_1 may overlap the first active layer DT1_ACT in the third direction (Z-axis direction), and the first-second contact hole CNT1_2 may overlap the second active layer DT2_ACT in the third direction (Z-axis direction).

The second contact hole CNT2 may be a hole that penetrates the gate insulating film 130, the first interlayer insulating film 141 and the second interlayer insulating film 142 to expose the second electrode D2_1 of the second-first transistor ST2-1. The first-second gate electrode DT1_G2 of the first driving transistor DT1 may be connected to the second electrode D2-1 of the second-first transistor ST2-1 through the second contact hole CNT2.

The third contact hole CNT3 may be a hole that penetrates the gate insulating film 130, the first interlayer insulating film 141 and the second interlayer insulating film 142 to expose the first electrode S1 of the first transistor ST1. The $j_{th}$ data line Dj may be connected to the first electrode S1 of the first transistor ST1 through the third contact hole CNT3.

The fourth contact hole CNT4 may be a hole that penetrates the gate insulating film 130, the first interlayer insulating film 141 and the second interlayer insulating film 142 to expose the second electrode D3 of the third transistor ST3 and the second electrode D3 of the fourth transistor ST4. The initialization connection electrode VIE may be connected to the second electrode D3 of the third transistor ST3 and the second electrode D3 of the fourth transistor ST4 through the fourth contact hole CNT4.

The fifth contact hole CNT5 may be a hole that penetrates the second interlayer insulating film 142 to expose the initialization voltage line VIL. The initialization connection electrode VIE may be connected to the initialization voltage line VIL through the fifth contact hole CNT5.

The sixth contact hole CNT6 may be a hole that penetrates the gate insulating film 130, the first interlayer insulating film 141 and the second interlayer insulating film 142 to expose the second electrode D6 of the sixth transistor ST6. The anode connection electrode ANDE may be connected to the second electrode D6 of the sixth transistor ST6 through the sixth contact hole CNT6.

The seventh contact hole CNT7 may be a hole that penetrates the gate insulating film 130, the first interlayer insulating film 141 and the second interlayer insulating film 142 to expose the first electrode S5 of the fifth transistor ST5. The first-second driving voltage line VDDL2 may be connected to the first electrode S5 of the fifth transistor ST5 through the seventh contact hole CNT7.

The eighth contact hole CNT8 may be a hole that penetrates the second interlayer insulating film 142 to expose the first-first driving voltage line VDDL1. The first-second driving voltage line VDDL2 may be connected to the first-first driving voltage line VDDL1 through the eighth contact hole CNT8.

The anode contact hole AND_CNT may be a hole that penetrates the protective film 150 and the planarization film 160 to expose the anode connection electrode ANDE.

A light emitting element layer may be disposed on the planarization film 160. The light emitting element layer may include light emitting elements 170 and a pixel defining film 180.

Each of the light emitting elements 170 may include a first electrode 171, an organic light emitting layer 172, and a second electrode 173.

The first electrode 171 may be disposed on the planarization film 160. The first electrode 171 may be connected to the anode connection electrode ANDE through the anode contact hole AND_CNT penetrating the protective film 150 and the planarization film 160.

In a top emission structure in which light is emitted from the organic light emitting layer 172 toward the second electrode 173, the first electrode 171 may include a metal material having high reflectance such as a laminated structure (Ti/Ai/Ti) of aluminum and titanium, a laminated structure (ITO/Al/ITO) of aluminum and ITO, an APC alloy, or a laminated structure (ITO/APC/ITO) of an APC alloy and ITO. The APC alloy refers to an alloy of silver (Ag), palladium (Pd), and copper (Cu).

The pixel defining film 180 may be disposed to divide the first electrode 171 on the planarization film 160 to define a light emitting area EA of each of the sub-pixels SP. The pixel defining film 180 may be disposed to cover the edge of the first electrode 171 and may include an organic film made of an acrylic resin, an epoxy resin, a phenolic resin, a polyamide resin, or a polyimide resin.

The light emitting area EA of each of the sub-pixels SP is defined as an area in which the first electrode 171, the organic light emitting layer 172, and the second electrode 173 are sequentially laminated, and thus holes from the first electrodes 171 are combined with electrons from the second electrode 173 to emit light.

The organic light emitting layer 172 may be disposed on the first electrode 171 and the pixel defining film 180. The organic light emitting layer 172 may include an organic material to emit light of a predetermined color. For example, the organic light emitting layer 172 may include a hole transporting layer, an organic material layer, and an electron transporting layer.

The second electrode 173 is disposed on the organic light emitting layer 172. The second electrode 173 may be disposed to cover the organic light emitting layer 172, and may be a common layer formed commonly in the sub-pixels SP. In some embodiments, a capping layer may be disposed on the second electrode 173.

In the top emission structure, the second electrode 173 may include a transparent conductive material (TCO) such as ITO or IZO, which can transmit light, or a semi-transmissive conductive material such as magnesium (Mg), silver (Ag) or an alloy of magnesium (Mg) and silver (Ag). When the second electrode 173 includes a semi-transmissive conductive material, light emission efficiency may be increased by microcavities.

An encapsulation layer TFE may be disposed on the light emitting element layer. The encapsulation layer TFE may include at least one inorganic film to prevent the penetration of oxygen or moisture into the light emitting element layer EML. Further, the encapsulation layer TFE may include at least one organic film to protect the light emitting element layer EML from foreign matter such as dust.

In some embodiments, a second substrate may be disposed on the light emitting element layer EML instead of the encapsulation layer TFE, and a space between the light emitting element layer EML and the second substrate may be empty in a vacuum state or may be provided with a filling film. The filling film may be an epoxy filled film or a silicon filled film.

Since the sub-pixel SP of the display device 10 may be configured to include a dual transistor in which the first driving transistor DT1 and the second driving transistor DT2 are connected in parallel, embodiments of the present disclosure provide a high driving current Ids by increasing the width of the active layer, as compared with the case where a single driving transistor is used.

Further, the first-first contact hole CNT1_1 and the first-second contact hole CNT1_2, which are respectively arranged in the first-first gate electrode DT1_G1 of the first driving transistor DT1 and the second gate electrode DT2_G of the second driving transistor DT2, may be symmetrical to each other with respect to the boundary between the first-first gate electrode DT1_G1 and the second gate electrode DT2_G, and may overlap each other in the second direction (i.e., the Y-axis direction, which may correspond to the direction of extension of the data lines), thereby minimizing the characteristic deviation between the first active layer DT1_ACT of the first driving transistor DT1 and the second active layer DT2_ACT of the second driving transistor DT2. Accordingly, embodiments of the present invention prevent the deterioration of image quality due to a difference in characteristics between the first driving transistor DT1 and the second driving transistor DT2.

Figure 14:
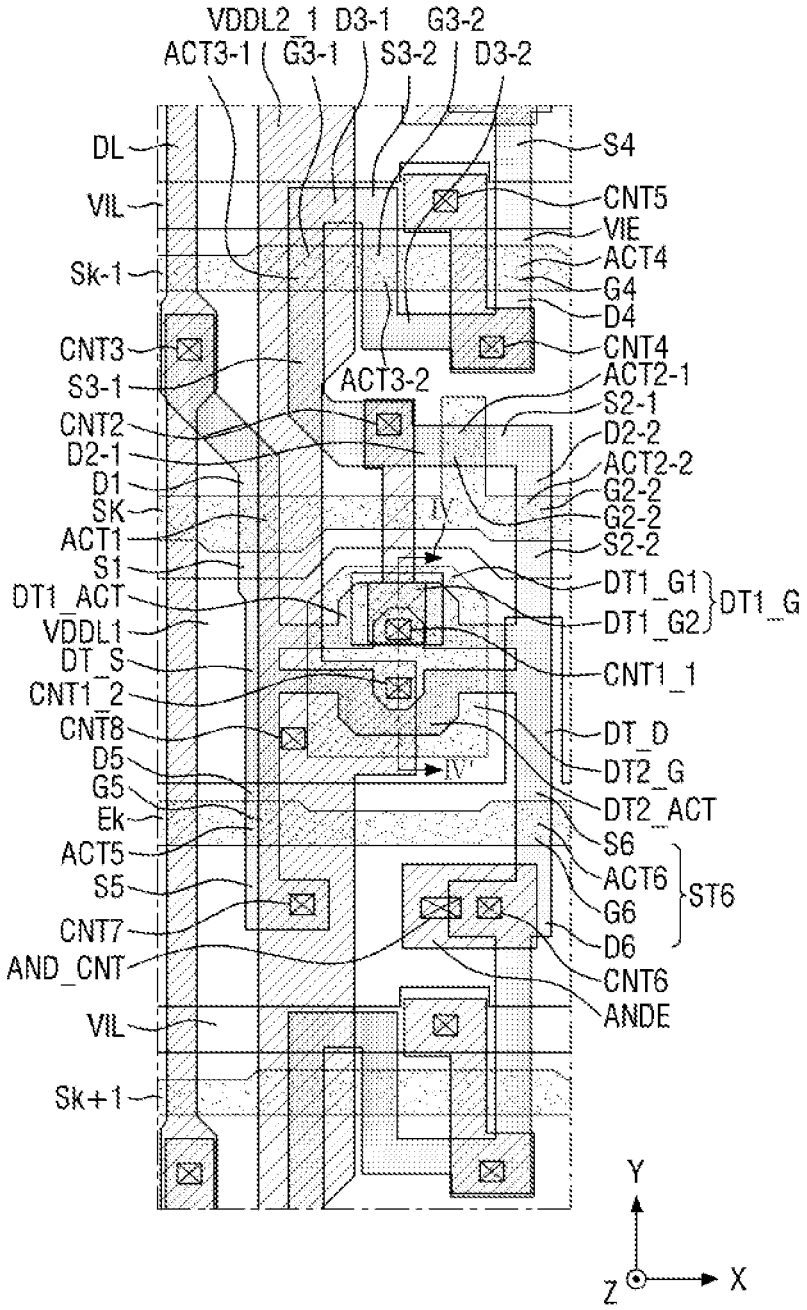
FIG. 14 is a detailed plan view of a sub-pixel according to another embodiment.
Figure 15:
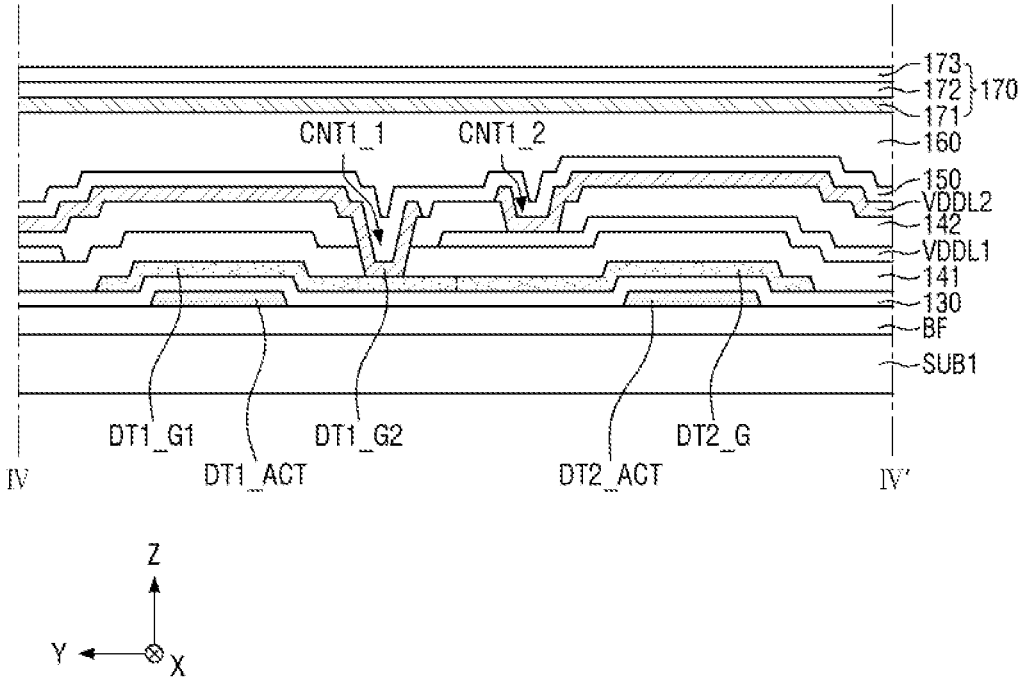
FIG. 15 is a cross-sectional view taken along the line IV-IV' of FIG. 14.

FIG. 14 is a detailed plan view of a sub-pixel according to another embodiment, and FIG. 15 is a cross-sectional view taken along the line IV-IV' of FIG. 14.

The embodiment of FIGS. 14 and 15 is different from the embodiment of FIGS. 10 and 13 in that the first-first driving voltage line VDDL1 and the first-second driving voltage line VDDL2_1 are electrically connected to each other through the first-second contact hole CNT1_2. Descriptions overlapping those of the embodiment of FIGS. 10 and 13 will be omitted, and differences will be described.

Referring to FIGS. 14 and 15, the first-second driving voltage line VDDL2_1 may extend to an area where the first-second contact hole CNT1_2 is disposed. Illustratively, the first-second driving voltage line VDDL2_1 may be configured to protrude in the first direction (X-axis direction) so as to partially overlap the second active layer DT2_ACT and second gate electrode DT2_G of the second driving transistor DT2. However, the present invention is not limited thereto, and the present invention includes various structural changes in which the first-second driving voltage line VDDL2_1 may overlap the first-second contact hole CNT1_2 in the third direction (Z-axis direction).

The first-first contact hole CNT1_1 may be a hole that penetrates the first interlayer insulating film 141 and the second interlayer insulating film 142 to expose the first-first gate electrode DT1_G1 of the first driving transistor DT1. The first-second gate electrode DT1_G2 of the first driving transistor DT1 may be connected to the first-first gate electrode DT1_G1 of the first driving transistor DT1 through the first-first contact hole CNT1_1.

The first-second contact hole CNT1_2 may be a hole that penetrates the second interlayer insulating film 142 to expose the first driving voltage line VDDL1 disposed on the second gate electrode DT2_G. The first-second driving voltage line VDDL2_1 may be connected to the first-first driving voltage line VDDL1 through the first-second contact hole CNT1_2.

Since a dual transistor in which the first driving transistor DT1 and the second driving transistor DT2 may be connected in parallel, a high driving current Ids may be provided by increasing the width of the active layer (i.e., as compared with the case where a single driving transistor is disposed).

Further, the first-first contact hole CNT1_1 and the first-second contact hole CNT1_2, which are respectively arranged in the first-first gate electrode DT1_G1 of the first driving transistor DT1 and the second gate electrode DT2_G of the second driving transistor DT2, may be symmetrical to each other with respect to the boundary between the first-first gate electrode DT1_G1 and the second gate electrode DT2_G, and may overlap each other in the second direction (Y-axis direction), thereby minimizing the characteristic deviation between the first active layer DT1_ACT of the first driving transistor DT1 and the second active layer DT2_ACT of the second driving transistor DT2. Accordingly, embodiments of the present invention prevent the deterioration of image quality due to a difference in characteristics between the first driving transistor DT1 and the second driving transistor DT2.

Moreover, the first-first driving voltage line VDDL1 and the first-second driving voltage line VDDL2_1 are electrically connected to each other through the first-second contact hole CNT1_2, and thus the eighth contact hole CNT8 may be omitted.

Figure 16:
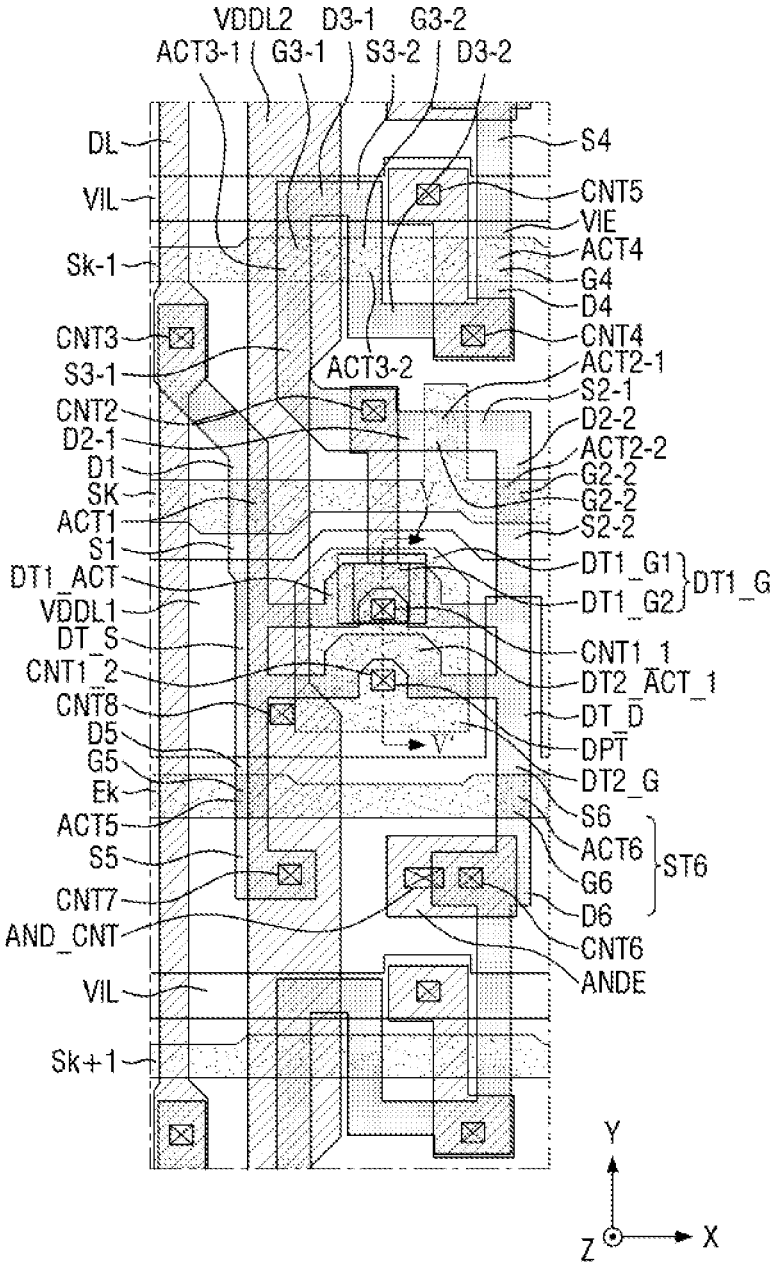
FIG. 16 is a detailed plan view of a sub-pixel according to another embodiment.
Figure 17:
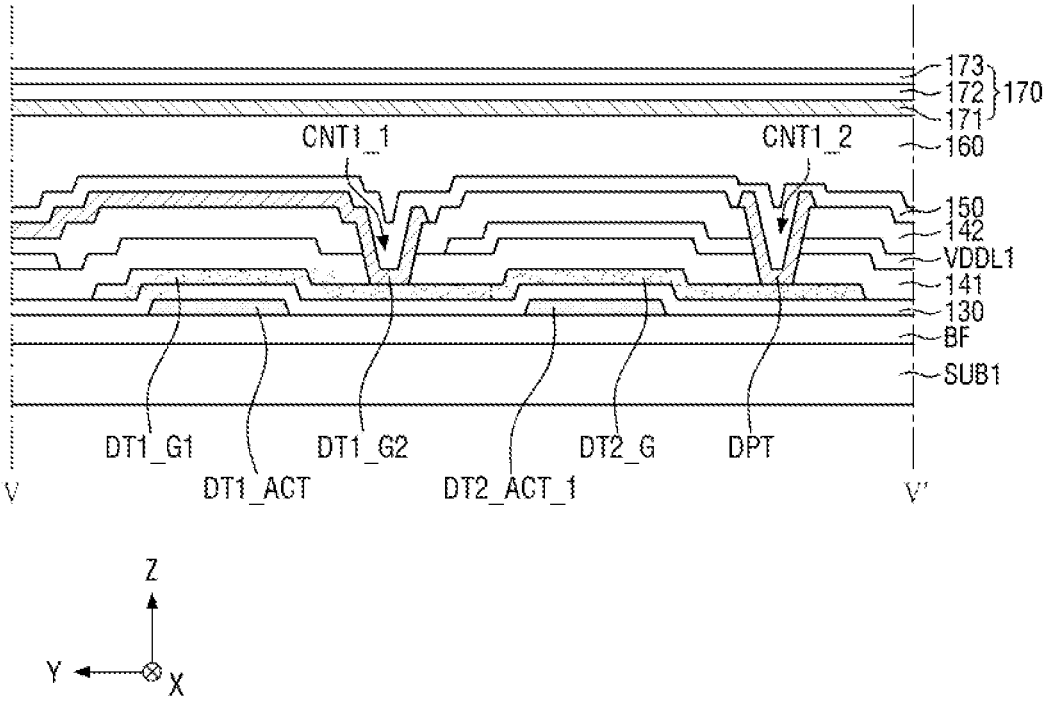
FIG. 17 is a cross-sectional view taken along the line V-V' of FIG. 16.

FIG. 16 is a detailed plan view of a sub-pixel according to another embodiment, and FIG. 17 is a cross-sectional view taken along the line V-V' of FIG. 16.

The embodiment of FIGS. 16 and 17 is different from the embodiment of FIGS. 10 and 13 in that the second active layer DT2_ACT_1 of the second driving transistor DT2 is bent in the same direction as the first active layer DT1_ACT of the first driving transistor DT1. Descriptions overlapping those of the embodiment of FIGS. 10 and 13 will be omitted, and differences will be described.

The first active layer DT1_ACT of the first driving transistor DT1 may overlap the first-first gate electrode DT1_G1 of the first driving transistor DT1 in the third direction (Z-axis direction), and the second active layer DT2_ACT_1 of the second driving transistor DT2 may overlap the second gate electrode DT2_G of the second driving transistor DT2 in the third direction (Z-axis direction).

The second active layer DT2_ACT_1 may have the same size and shape as the first active layer DT1_ACT but may be disposed to be spaced apart from the first active layer DT1_ACT in a direction opposite to the second direction. Illustratively, each of the first active layer DT1_ACT and the active layer DT2_ACT_1 may be disposed to be bent in the second direction (Y-axis direction).

The first-first contact hole CNT1_1 may be disposed between the first active layer DT1_ACT and the second active layer DT2_ACT_1 in the second direction (Y-axis direction), and the first-second contact hole CNT1_2 may be disposed in the second active layer DT2_ACT_1 in a direction opposite to the second direction (Y-axis direction). For example, the first-first contact hole CNT1_1 and the first-second contact hole CNT1_2 may overlap each other in the second direction (Y-axis direction), and the second active layer DT2_ACT_1 may be located between the first-first contact hole CNT1_1 and the first-second contact hole CNT1_2.

Since a dual transistor in which the first driving transistor DT1 and the second driving transistor DT2 may be connected in parallel is provided, a high driving current Ids may be provided by increasing the width of the active layer (i.e., compared to the case where a single driving transistor is disposed).

Further, the first-first contact hole CNT1_1 and the first-second contact hole CNT1_2 may overlap each other in the second direction (Y-axis direction), thereby minimizing the characteristic deviation between the first active layer DT1_ACT of the first driving transistor DT1 and the second active layer DT2_ACT of the second driving transistor DT2. Thus, it is possible to prevent the deterioration of image quality due to a difference in characteristics between the first driving transistor DT1 and the second driving transistor DT2.

Figure 18:
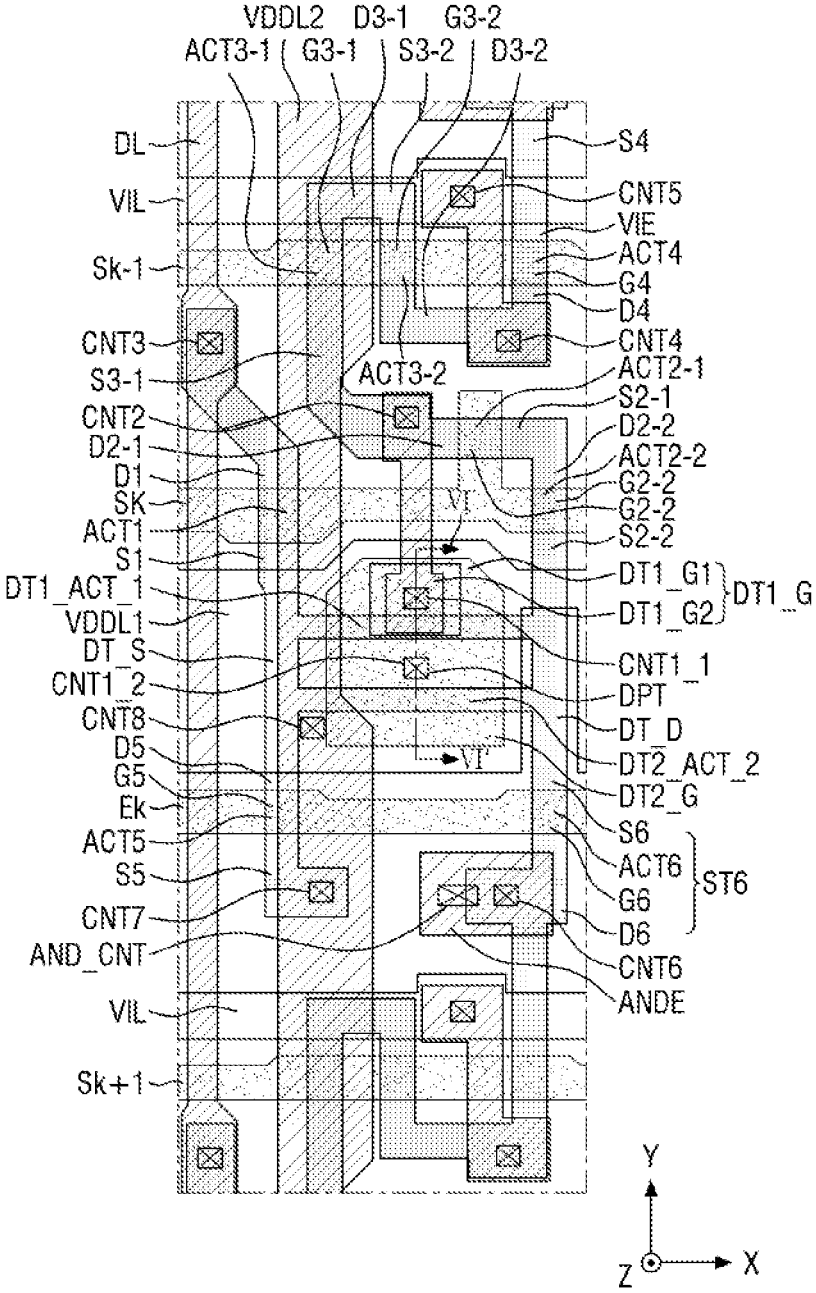
FIG. 18 is a detailed plan view of a sub-pixel according to another embodiment.
Figure 19:
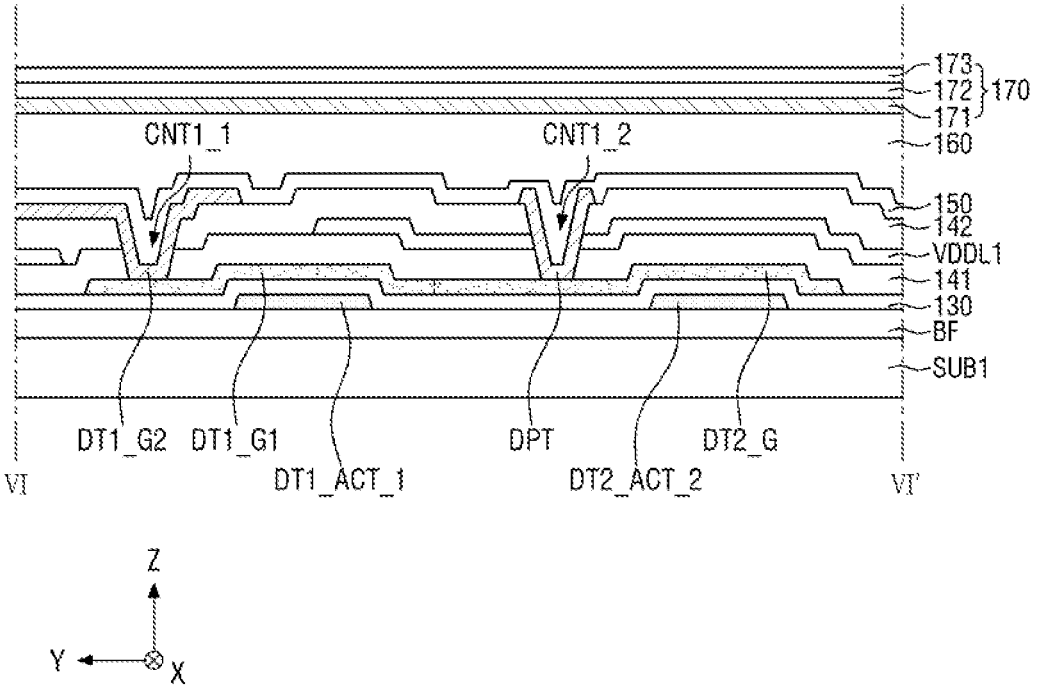
FIG. 19 is a cross-sectional view taken along the line Vi-VI' of FIG. 18.

FIG. 18 is a detailed plan view of a sub-pixel according to another embodiment, and FIG. 19 is a cross-sectional view taken along the line Vi-VI' of FIG. 18.

The embodiment of FIGS. 18 and 19 is different from the embodiment of FIGS. 10 and 13 in that each of the first active layer DT1_ACT_1 and the second active layer DT2_ACT_2 has a bar shape extending in the first direction (X-axis direction). Descriptions overlapping those of the embodiment of FIGS. 10 and 13 will be omitted, and differences will be described.

The first active layer DT1_ACT_1 of the first driving transistor DT1 may overlap the first-first gate electrode DT1_G1 of the first driving transistor DT1 in the third direction (Z-axis direction), and the second active layer DT2_ACT_2 of the second driving transistor DT2 may overlap the second gate electrode DT2__G of the second driving transistor DT2 in the third direction (Z-axis direction).

The first active layer DT1_ACT_1 and the second active layer DT2_ACT_2 may extend in the first direction (X-axis direction) without being bent, and may be spaced apart from each other in the second direction (Y-axis direction).

The first-first contact holes CNT1_1 may be disposed to be spaced apart from the second active layer DT1_ACT_1 in the second direction (Y-axis direction), and the first-second contact hole CNT1_2 may be disposed between the first active layer DT1_ACT_1 and the second active layer DT2_ACT_2. Illustratively, the first-first contact hole CNT1_1, the first active layer DT1_ACT_1, the first-second contact hole CNT1_2, and the second active layer DT2_ACT_2 may be sequentially arranged in a direction opposite to the second direction (Y-axis direction), and the first-first contact hole CNT1_1 and the first-second contact hole CNT1_2 may overlap each other in the second direction (Y-axis direction).

Since a dual transistor in which the first driving transistor DT1 and the second driving transistor DT2 may be connected in parallel, a high driving current Ids may be provided by increasing the width of the active layer (i.e., compared with the case where a single driving transistor is used).

Further, the first-first contact hole CNT1_1 and the first-second contact hole CNT1_2 may overlap each other in the second direction (Y-axis direction), thereby minimizing the characteristic deviation between the first active layer DT1_ACT_1 of the first driving transistor DT1 and the second active layer DT2_ACT_2 of the second driving transistor DT2. Accordingly, it may be possible to prevent the deterioration of image quality due to a difference in characteristics between the first driving transistor DT1 and the second driving transistor DT2.

Moreover, since each of the first active layer DT1_ACT_1 and the second active layer DT2_ACT_2 has a bar shape extending in the first direction (X-axis direction) without being bent, the length of each of the first active layer DT1_ACT_1 and the second active layer DT2_ACT_2 may decrease to provide higher driving current Ids, thereby realizing a high-luminance display device 10.

As described above, according to the display device 10 in some embodiments, high luminance can be realized by increasing the driving current supplied to a light emitting element, and image quality can be improved by minimizing the characteristic deviation of driving transistors.

The effects of the present invention are not limited by the foregoing, and other various effects are anticipated herein.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A display device, comprising:

a sub-pixel including a light emitting area;

wherein the sub-pixel includes:

a first driving transistor and a second driving transistor, each of which control a current flowing from a first electrode to a second electrode in accordance with a data voltage applied to a gate electrode;

a light emitting element connected to the second electrodes of the first driving transistor and the second driving transistor; and a first contact hole and a second contact hole which are disposed in the gate electrode, wherein the gate electrode includes a first gate electrode overlapping the first driving transistor in a thickness direction and a second gate electrode overlapping the second driving transistor in the thickness direction, and the first contact hole is located in the first gate electrode, the second contact hole is located in the second gate electrode, and the first contact hole and the second contact hole overlap each other in a first direction perpendicular to the thickness direction.

2. The display device of claim 1, wherein the first driving transistor includes a first active layer, the second driving transistor includes a second active layer, the first active layer overlaps the first gate electrode in the thickness direction, and the second active layer overlaps the second gate electrode in the thickness direction.

3. The display device of claim 2, wherein the second gate electrode extends from the first gate electrode in the first direction.

4. The display device of claim 3, further comprising:

a third gate electrode disposed on the first gate electrode and electrically connected to the first gate electrode through the first contact hole.

5. The display device of claim 4, wherein the first active layer includes a first bent portion bent in a direction opposite to the first direction, the second active layer includes a second bent portion bent in the first direction, and the first bent portion and the second bent portion are symmetrical to each other with respect to a boundary between the first gate electrode and the second gate electrode.

6. The display device of claim 5, wherein the first active layer, the first contact hole, the second contact hole, and the second active layer are sequentially arranged in the first direction.

7. The display device of claim 6, further comprising:

a dummy pattern electrically connected to the second gate electrode through the second contact hole.

8. The display device of claim 6, further comprising:

a first driving voltage line to which a first driving voltage is applied; and a second driving voltage line crossing the first driving voltage line, wherein the second driving voltage line is electrically connected to the first driving voltage line through the second contact hole.

9. The display device of claim 7, further comprising:

a scan line extending in a second direction crossing the first direction;

a data line extending in the first direction; and a first driving voltage line which extends in the second direction and to which a first driving voltage is applied.

10. The display device of claim 9, further comprising:

a second driving voltage extending in the first direction and electrically connected to the first driving voltage line through a third contact hole wherein the third contact hole does not overlap the first gate electrode and the second gate electrode in the thickness direction.

11. The display device of claim 10, wherein the first driving voltage line includes an opening, and the opening overlaps the first contact hole in the thickness direction.

12. The display device of claim 11, further comprising:

at least one insulating film disposed between the first driving voltage line and the second electrode of each of the first driving transistor and the second driving transistor.

13. The display device of claim 12, wherein the at least one insulating film includes a gate insulating film disposed on the second electrodes of the first driving transistor and the second driving transistor, and an interlayer insulating film disposed on the first gate electrode and the second gate electrode.

14. The display device of claim 13, wherein each of the first gate electrode and the second gate electrode is disposed on the gate insulating film.

15. The display device of claim 14, wherein the first driving voltage line is disposed on the interlayer insulating film.

16. The display device of claim 15, wherein the first active layer and the second active layer are covered by the gate insulating film.

17. The display device of claim 4, wherein the first active layer includes a first bent portion bent in a direction opposite to the first direction, the second active layer includes a second bent portion bent in a direction opposite to the first direction, and the first bent portion and the second bent portion have the same shape.

18. The display device of claim 17, wherein the first active layer, the first contact hole, the second active layer, and the second contact hole are sequentially arranged in the first direction.

19. The display device of claim 4, wherein each of the first active layer and the second active layer has a bar shape extending in a second direction crossing the first direction.

20. The display device of claim 19, wherein the first contact hole, the first active layer, the second contact hole, and the second active layer are sequentially arranged in the first direction.

21. A sub-pixel of a display device, comprising:

a first driving transistor;

a second driving transistor connected in parallel to the first driving transistor;

a light emitting element connected to electrodes of the first driving transistor and the second driving transistor;

a first contact hole located within a first gate electrode of the first driving transistor; and a second contact hole located within a second gate electrode of the second driving transistor, and overlapping the first contact hole in a direction perpendicular to a thickness direction.

* * * * *